US007685960B1

(12) United States Patent
Carusello et al.

(10) Patent No.: US 7,685,960 B1
(45) Date of Patent: Mar. 30, 2010

(54) MOVABLE SHADE ASSEMBLY FOR WATERCRAFT

(76) Inventors: Kenneth J. Carusello, 530 Bianca Ave., Coral Gables, FL (US) 33146; German Alvarez-Fuentes, 511 Bianca Ave., Coral Gables, FL (US) 33146

( * ) Notice: Subject to any disclaimer, the term of this patent is extended or adjusted under 35 U.S.C. 154(b) by 0 days.

(21) Appl. No.: 11/725,587

(22) Filed: Mar. 19, 2007

Related U.S. Application Data

(60) Provisional application No. 60/783,780, filed on Mar. 17, 2006.

(51) Int. Cl.
*B63B 17/00* (2006.01)

(52) U.S. Cl. ..... 114/361

(58) Field of Classification Search ..... 114/361
See application file for complete search history.

(56) References Cited

U.S. PATENT DOCUMENTS 2,493,833 A * 1/1950 Reynolds ..... 114/361
4,641,600 A * 2/1987 Halvorsen ..... 114/361
4,838,195 A * 6/1989 Carter ..... 114/343
2002/0053313 A1 * 5/2002 Murphy et al. ..... 114/361

* cited by examiner

*Primary Examiner*—Stephen Avila
(74) *Attorney, Agent, or Firm*—Malloy & Malloy, P.A.

(57) ABSTRACT

A shade assembly for a watercraft comprising at least one attachment device and a cover assembly. The attachment device includes at least one mounting assembly structured to be connected to any one of a plurality of predetermined portions of the watercraft. The cover assembly is structured to provide protection of various parts of the watercraft from at least sun exposure by producing a shaded area. At least one adjustment assembly is disposed in interconnecting relation between the mounting assembly and the cover assembly, and is structured to selectively dispose said the cover assembly in any one of a plurality of operative positions relative to the mounting assembly and the various parts of the watercraft.

34 Claims, 25 Drawing Sheets

MOVABLE SHADE ASSEMBLY FOR WATERCRAFT

CLAIM OF PRIORITY

The present application is based on and a claim of priority is made under 35 U.S.C. Section 119(e) to provisional patent application currently pending in the U.S. Patent and Trademark Office having Ser. No. 60/783,780 and a filing date of Mar. 17, 2006.

BACKGROUND OF THE INVENTION

1. Field of the Invention

This invention relates to a movable and/or adjustable shade assembly which can be attached to watercraft of different sizes, styles and configurations so as to provide shade and/or shelter to portions of the craft normally exposed to various weather conditions. The various embodiments of the shade assembly may comprise a cover assembly and an attachment device, which may have at least one mounting assembly and one or more adjustment assemblies cooperatively structured to selectively shade or otherwise protect various exposed areas of the craft by an adjustable and/or movable disposition of the cover assembly into any one of a plurality of operative positions.

2. Description of the Related Art

The recreational and leisure activities typically associated with watercraft including boats of various sizes are widespread. These include but are not limited to fishing, whether in deep or shallow water, diving, snorkeling, water-skiing, etc. However, as participants of an outdoor activity, individuals driving or riding in the various types of watercraft, hereinafter referred to as boaters, are subjected to the direct effects of the weather and often for extended periods of time. As just one example, when a boater spends an entire day or afternoon out on the water in sunny weather, he or she faces the likelihood of having his/her skin become tanned, red and/or burned from prolonged exposure to the sun's rays, unless certain precautions are taken. This is particularly true for persons riding on smaller-sized craft, which do not have an interior cabin or exterior shade structures, or which are primarily designed for fishing, such as those boats known as "open-fishermen."

In addition, it is well known that some people and/or children riding on boats do not enjoy sitting in the sun for long periods and become uncomfortable, hot and/or sweaty after only a short period of time. As a result, a boating or fishing enthusiast may find that his/her invitation to have friends and family, spend a day out on the boat, may not generate much excitement. Understandably, there are times when some or all of the people riding on boats, and particularly smaller-sized boats, either want or need to be under some shelter or shade while on the boat, whether due to the presence of direct sunlight or any other type of weather condition, including rain.

In order to protect the boat, the boating equipment, and/or boaters from the direct effects of the weather, some watercraft, such as the "open fisherman" mentioned above, provide at least a minimal amount of shelter by including a structure on them known as a "T-Top" typically defined by a canvas or other more rigid material top, which may be supported by a generally tubular frame and support poles. This "T-Top" type of structure typically covers only a central portion of the deck where the boat's steering wheel, column, related equipment and console are located. Consequently, the remaining portions of the watercraft, such as the bow and the rear or stern portions are generally exposed to direct sunlight, rain and/or other effects of the weather.

Additionally, there may be a general tendency for the bow of the boat to swing, turn into the wind or otherwise be reoriented while anchored or drifting. This will frequently result in different exterior portions of the craft being exposed to the sun. Under normal operating conditions of the type set forth herein, the ability to control or direct the angle of the sun relative to the orientation of the boat is limited. Accordingly, many substantially fixed shade or cover structures such as, but not limited to, the aforementioned "T-Top" structures, are inadequate for the purpose of providing sufficient shade for many if not the majority of exterior portions of a watercraft. It is thought by the inventor(s) hereof that if there were a convenient way to selectively shade or cover various, normally exposed portions of different types of watercraft, it would greatly increase the enjoyment in using and operating the watercraft as intended.

As a result, there is a need in the field of boating equipment for a movable and/or adjustable shade assembly that can be adapted for use with various types and sizes of watercraft. Such a proposed shade assembly would be capable of providing selectively positionable shade and/or shelter beyond that which is provided by fixed or permanent structures such as a T-Top structure typically found on "open fisherman". However, a proposed shade assembly should also demonstrate sufficient versatility to be mounted on or attached to existing shade structures as well as other portions of the craft including, but not limited to, a radar arch or other structures. For example, enclosed cabins or partial shade structures are typically found on "sport fisherman" boats or watercrafts, which often have open and unsheltered rear decks and/or cockpits that similarly could benefit from the movable shade assembly identified herein.

Further, any such proposed shade assembly should preferably be easily adjustable so that the device may be easily disposable in any of a plurality of operative positions capable of generating shade or like protection to different, normally exposed areas of the craft. Also, a proposed shade assembly should be connected and disconnected so as to allow its selective relocation to various areas of the watercraft when desired and so that the boat can freely travel to another locale at a normal or high rate of speed.

Further, it would be beneficial if the proposed movable and/or adjustable shade assembly would be further structured to allow the orientation thereof to be efficiently changed while being mounted in any one of a plurality of different locations on the watercraft. As such, the shade assembly could be readily adapted to accommodate the frequently changing orientations of the boat as well as the changing angles of the sun's rays throughout the course of a day.

SUMMARY OF THE INVENTION

The present invention is directed to a shade assembly which is structured and operative to overcome the various disadvantages and problems, of the type prevalent with known or conventional shade structures typically associated with various types of watercraft. Further, the shade assembly of the present invention may be structured to be readily adjustable and/or movable. Also, at least some of the preferred embodiments are removably mounted so as to facilitate their mounting or placement at any one of a plurality of different locations on the watercraft. The specific location where one or more of the preferred embodiments of the shade assembly are located could be dependent on a number of factors including the overall structural configuration of the watercraft, the disposition and structure of existing shading devices, if any, located on the watercraft, as well as the orientation of the craft when anchored, drifting, or traveling, relative to the orientation of the sun.

More specifically, each of the plurality of preferred embodiments of the present invention is directed to a shade assembly designed to be movably and/or adjustably mounted at any of a plurality of different locations on a watercraft. As such, the adjustable nature of the shade assembly of the present invention allows it to be disposed in any one of a plurality of operative positions by adjustment of the orientation of a cover assembly thereof, while in a single, predetermined position. Alternatively at least some of the various embodiments of the shade assembly are structured to be quickly and easily removably connected to different portions and/or locations on the watercraft when needed to protect selected parts of the watercraft from exposure to the sun or other weather conditions.

Accordingly, at least one of the plurality of preferred embodiments of the present invention comprises at least one but more practically a plurality of two attachment devices each having a mounting assembly structured to be interconnected to a substantially common, predetermined portion of the watercraft. In addition, at least one but more practically, a plurality of adjustment assemblies, preferably equal in number to the plurality of mounting assemblies, are movable and/or adjustably connected to corresponding ones of the mounting assemblies. Further, the cover assembly is connected to each of the one or more adjustment assemblies and as such, is adjustably positioned into any one of a plurality of different operative positions, as generally set forth above. By virtue of the interconnection of the one or more mounting assemblies to respective ones of the adjustment assemblies, the cover assembly is therefore movably and/or adjustably connected to a substantially common, predetermined portion of the watercraft. Also, by virtue of the fact that each of the one or more mounting assemblies is removably connected to a predetermined portion of the watercraft, the shade assembly may be detached therefrom and relocated to other portions of the watercraft.

Additional structural details of at least some of the preferred embodiments of the shade assembly comprise the cover assembly including a single cover element formed from a canvas or other material, which is water repellent and sufficiently structured to produce shaded areas in preferred locations on the exterior of the craft. In addition the cover assembly includes at least one but more practically a plurality of two support arms. Each of the support arms are connected to a different one of the adjustment assemblies and movable at least partially therewith.

Therefore, the aforementioned plurality of different operative positions may be easily accomplished by the adjustable movement or positioning of the adjustment assembly, relative to respective ones of the mounting assemblies serving to interconnect the shade assembly to the aforementioned, substantially common, predetermined portion of the watercraft.

Moreover, each of the one or more support arms comprises an elongated configuration, wherein two cooperatively disposed support arms engage and support opposite or other peripheral portions of the cover member. Further, the longitudinal dimensions of the support arms, as well as the transverse and longitudinal dimensions of the cover member, are such as to extend the cover member outwardly at any of a plurality of different orientations relative to the portion of the watercraft to which the associated mounting assemblies are removably secured. Such outward extension, in combination with the overall predetermined dimension and configuration of the cover assembly provide a shaded area over a correspondingly disposed portion of the watercraft.

Yet another preferred embodiment of the shade assembly of the present invention is structured to be similarly operative in terms of comprising a cover assembly, and at least one attachment device having a mounting assembly and at least one adjustment assembly. More specifically, this additional preferred embodiment preferably comprises two attachment devices each having mounting assemblies structured and cooperatively disposed to connect the shade assembly to a substantially common, predetermined portion of the watercraft. Further, each of the mounting assemblies is associated with a different one of a plurality of at least two adjustment assemblies. Also, each of the adjustment assemblies are connected to different elongated support arms which are in turn connected in supporting relation to a cover member of the cover assembly.

Distinguishing structural and/or operative features of this additional preferred embodiment of the shade assembly of the present invention includes the adjustment assembly being removably connected to corresponding ones of the mounting assembly. As such, selective adjustment or repositioning of the cover assembly in any one of a plurality of operative, protective positions includes the removal of at least a portion of the adjustment assembly and a reattachment thereof in a different orientation. In doing so, the cover assembly is selectively disposed in any one of a plurality of different angular orientations, as the cover member extends outwardly from the substantially common portion of the watercraft to which it is attached. Accordingly, a shade area is generated by the outward extension and/or angular orientation of the cover member relative to the portion of the watercraft to which it is attached.

A structural modification of this and possibly other preferred embodiments, which defines yet another preferred embodiment, comprises the cover assembly including a single support arm having an arcuate or other predetermined configuration extending about a "leading" portion of the periphery of the cover member. In addition, opposite longitudinal ends of the single support arm are secured to different ones of two, spaced apart attachment devices. In turn, each of the attachment devices may be movably and adjustably connected to corresponding ones of two different mounting assemblies by virtue of an adjustment assembly. As with others of the preferred embodiments of the present invention, the cooperatively disposed mounting assemblies may be removably connected to a substantially common portion of the watercraft and are easily detached therefrom so as to relocate the shade assembly to any of a plurality of other locations on the watercraft.

Yet another preferred embodiment of the shade assembly of the present invention is structured to be similarly operative in terms of comprising a cover assembly, and at least one attachment device having at least one mounting assembly and at least one adjustment assembly. More specifically, this preferred embodiment preferably comprises two attachment devices each having a mounting assembly structured and cooperatively disposed to connect the shade assembly to a substantially common, predetermined portion of the watercraft. Further, each of the adjustment assemblies are connected to different elongated support arms which are in turn connected in supporting relation to a cover member of the cover assembly.

Distinguishing structural and/or operative features of this additional preferred embodiment of the shade assembly of the present invention includes the adjustment assembly being structurally corresponding to the mounting assembly. As such, selective adjustment or repositioning of the cover assembly in any one of a plurality of operative, protective positions includes the loosening of at least a portion of the adjustment assembly and/or mounting assembly and a retightening or reattachment thereof in a different orientation. In doing so, the cover assembly is selectively disposed in any one of a plurality of different angular orientations as the cover member extends outwardly from the substantially common portion of the watercraft to which it is attached. Accordingly, a shade area is generated by the outward extension and/or angular orientation of the cover member relative to the portion of the watercraft to which it is attached.

Another distinguishing structural and/or operative feature of this additional preferred embodiment of the shade assembly of the present invention includes two channels or other receiving members on each attachment device such that the support arm may be selectively secured and disposed within the channels either laterally or transversely relative to the attachment device. As with the other preferred embodiments of the present invention, the cooperatively disposed mounting assemblies may be removably connected to a substantially common portion of the watercraft and may be easily detached therefrom so as to relocate the shade assembly to any of a plurality of other locations on the watercraft.

Yet another preferred embodiment of the present invention is directed to a shade assembly having a retractable or selectively expandable and retractable operation and structure. As with at least some of the above described embodiments of the shade assembly, this embodiment comprises a mounting assembly structured to be secured to at least one predetermined portion of the watercraft. An adjustment assembly is connected to the mounting assembly and as such is connected to the watercraft. In turn, the cover assembly is connected to and is at least partially supported by the adjustment assembly and comprises a flexible material cover member and at least one, but more practically, a plurality of two support arms. Each of the support arms includes movable, interconnected segments which allow a selective expansion and retraction of the support arms, as well as the cover member at least partially supported thereby. Distinguishing structural and operative features include the adjustable assembly being motor operated, such as by an electrically powered drive assembly or alternatively manually powered, wherein the cover assembly is selectively disposed into and out of an outwardly extending, operative position by manual activation. In the latter structural variation, a crank handle or arm may be connected to the drive assembly. Further when in a stored orientation, as versus an operative position, the cover member is retracted back into the interior of a housing, wherein the housing is connected to the mounting assembly and as such, is connected to or mounted on a predetermined portion of the watercraft. Therefore, when the cover member is in its non-operative or stored orientation, it is substantially hidden by being retracted onto a spindle or like structure on the interior of the housing, wherein the housing itself or at least portions thereof retain the stored cover member until further use is desired.

Yet another embodiment of the present invention is directed to an attachment device being structurally integrated with at least one predetermined portion of a watercraft. The integrated attachment device(s) may include one or more holes, cavities, or other receiving members structured to receive or accept the support arms or other supporting structures therein. The attachment device may include any structure to facilitate the support arms, or other supporting structures, to be inserted therein and retracted therefrom. Additionally, the shade assembly of at least one embodiment may include a drawer-like retractable mechanism at least partially integrated with at least one predetermined portion of the watercraft.

Based on the above and on a further more detailed description of the various preferred embodiments of the shade assembly of the present invention, many if not all of the disadvantages and problems associated with conventional shade structures on various types of watercraft are overcome. More specifically, the operative and structural versatility of the shade assembly of the present invention facilitate its selective disposition in any one of a plurality of operative, protective positions so as to accommodate orientations of the watercraft, on which it is mounted, and the sun. Such versatility allows an operator of the shade assembly of the present invention the ability to selectively protect different exterior deck areas or other exterior portions of the watercraft from exposure to the sun or other weather conditions.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
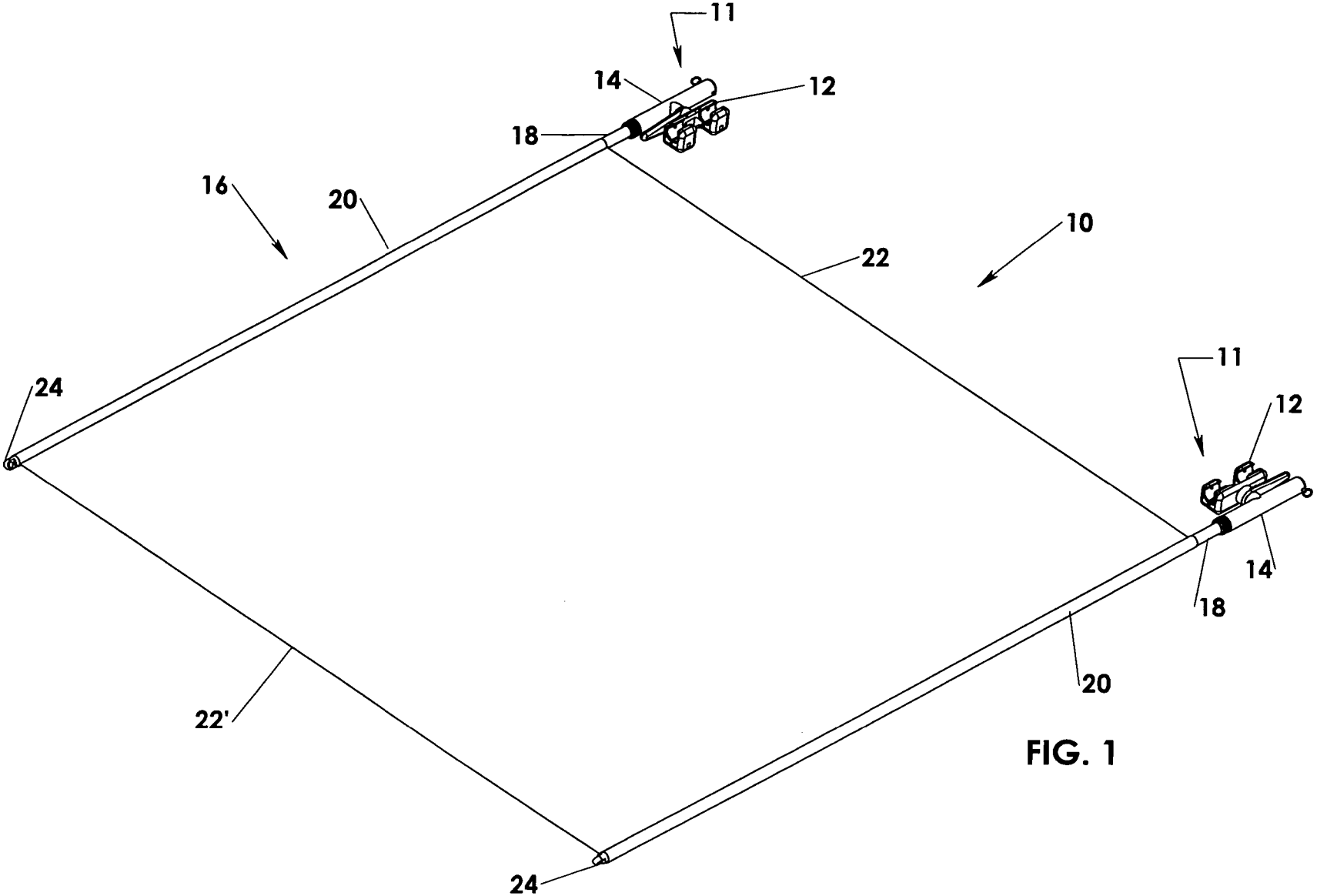
FIG. 1 is a perspective view of one preferred embodiment of a shade assembly of the present invention structured to be removably and adjustably mounted on any one of a plurality of portions of a watercraft.

As shown in the accompanying drawings, the present invention is directed to a shade assembly wherein at least one preferred embodiment is generally indicated as and shown in detail in FIGS. 1 through 4. More specifically, the shade assembly 10 includes at least one, but more practically a plurality of two attachment devices 11, each having at least one mounting assembly 12. Each of the mounting assemblies 12 are structured to be removably connected to a predetermined portion of a watercraft. The versatility of the structure and operation of each of the mounting assemblies 12, as represented in detail in FIGS. 1 through 4, facilitate the removable attachment or connection of the shade assembly 10 to various portions of the watercraft and/or structure associated with the watercraft. By way of example only, the mounting assemblies 12 may be removably secured to the tubular frame portion(s) of a radar arch, "t-top", "Bimini top" or like canvas or other material shading structures typically used on an "open fisherman" type of boat, as well as a variety of other watercraft. As will be apparent throughout the detailed description of the other plurality of preferred embodiments of the present invention, the shade assembly 10 may be attached to various portions or components of the watercraft and is not limited to attachment to tubular frame portions thereof. More specifically, the mounting assemblies 12 may comprise a generally flat structure such that the mounting assemblies 12 may be attached to a generally flat or other similarly shaped surface(s) or component(s) of the watercraft. In addition, the attachment device 11 may not include a mounting assembly 12, but rather, the attachment device 11 may be structurally integrated with at least one predetermined portion of a watercraft. In addition, the shade assembly 10 of the present invention may be attached, secured, integrated, or otherwise connected to any overhang, ceiling, or other portions or structures on a boat, yacht, or other watercraft.

The shade assembly 10 also comprises at least one, but more practically a plurality of at least two adjustment assemblies 14. As represented in FIGS. 1 through 4, each of the mounting assemblies is interconnected in supporting relation to a cover assembly generally indicated as 16 by means of at least one but more practically two spaced apart support arms 18. Each of the support arms 18 have an elongated configuration and are removably or fixedly secured to opposite peripheral edges or sides 20 of a cover member generally indicated as 22.

The cover member 22 is preferably formed from a canvas or other appropriate and preferably water repellant material. The cover member 22 is of sufficient dimension to extend along substantially all, or at least a majority of, the length of the respective support arms 18, such that the outer peripheral edge or end 22' is substantially aligned with the outer extremity 24 of each of the support arms 18. Attachment and at least partial support of the cover member 22 by the support arms 18 may be accomplished by a variety of different attachment facilities such as hook and loop type fasteners, open ended sleeves or channels formed in the cover member 22 through which the respective support arms 18 extend or any of a number of other appropriate connector facilities. As such, the cover member 22 is preferably, but not necessarily, removably secured in any one of a plurality of possible operative and protective positions. With further regard to FIG. 1, the overall dimension and configuration of the cover member 22 as well as the support arms 18 may vary. However, the size and shape thereof should be sufficient to generate a sufficient amount of shade over the exterior decks or other exterior portions of the watercraft when the cover member 22 is in any one of a plurality of operative positions, as will be explained in greater detailed hereinafter.

Figure 3:
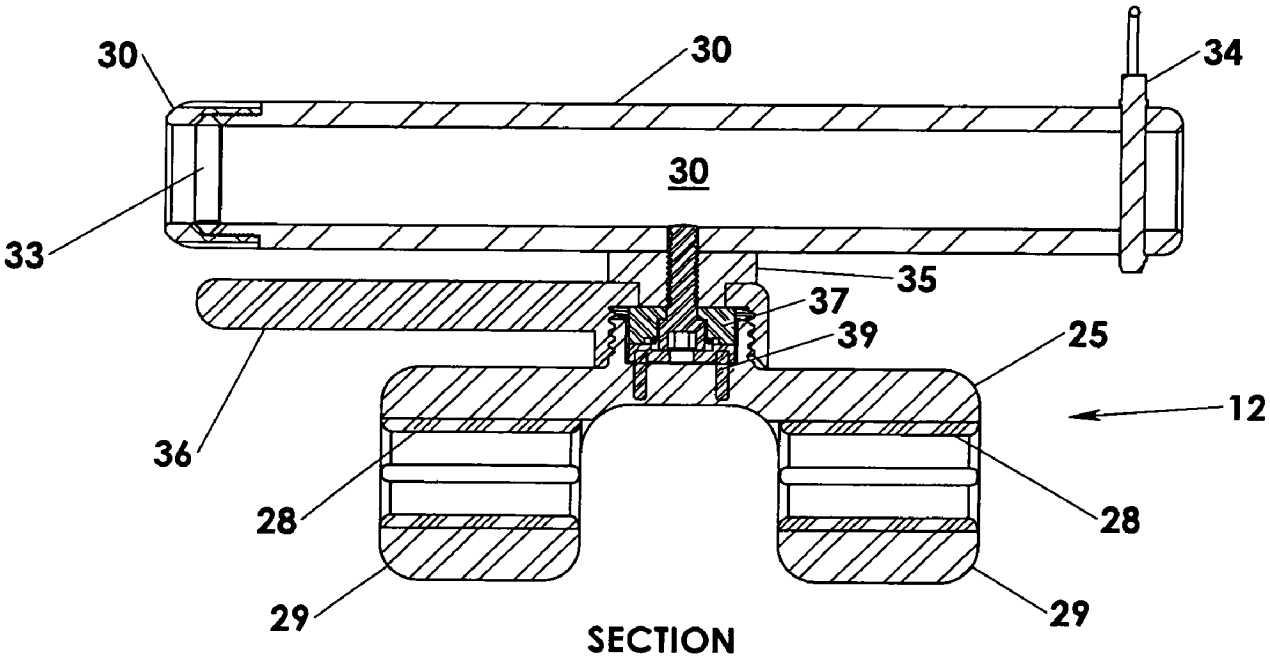
FIG. 3 is a sectional view along line A-A of FIG. 2.
Figure 2:
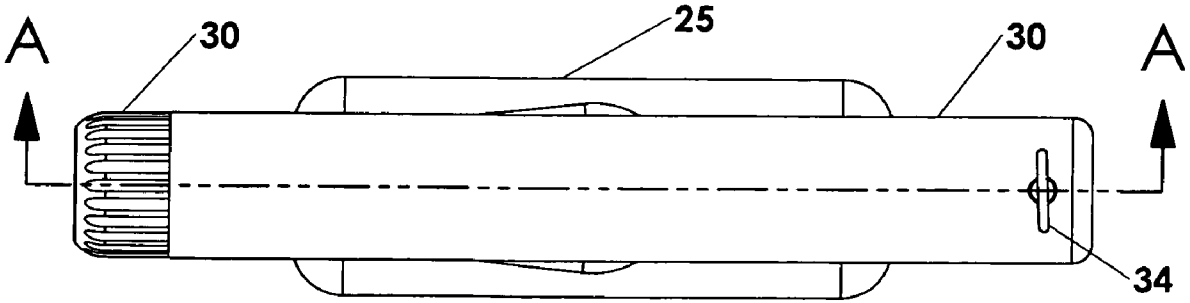
FIG. 2 is a side view of the exterior of an adjustment assembly of the embodiment of FIG. 1.
Figure 4:
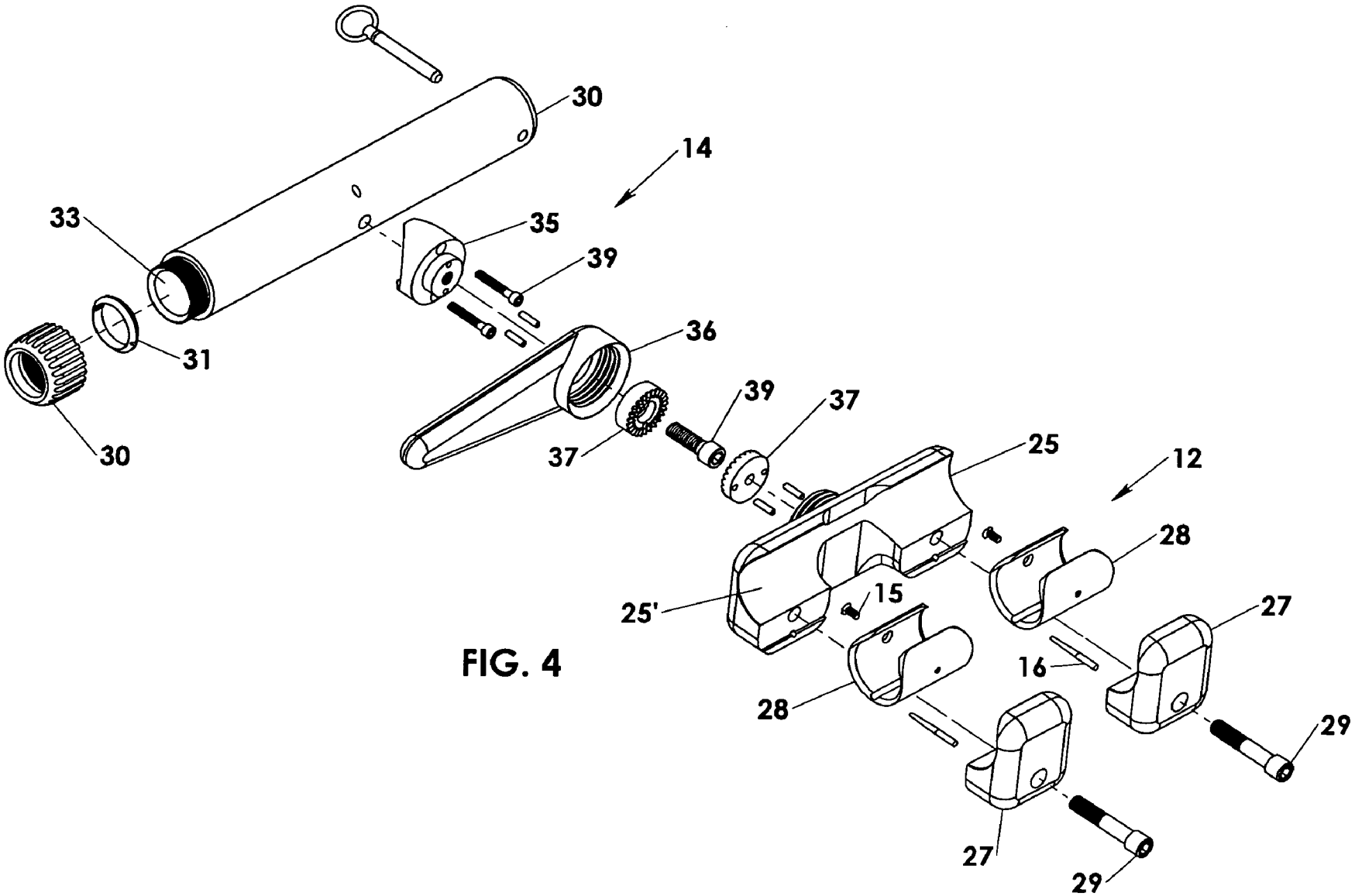
FIG. 4 is an exploded view of an adjustment assembly and a mounting assembly of the embodiment of FIG. 1 represented in an unassembled form.

With reference to FIGS. 2 through 4, the mounting assembly 12 comprises a base 25 having a mounting channel or interior area 25' also defined by removably attached clamp(s) 27 secured into the assembled position, as represented in FIGS. 2 and 3 by means of set or locking screws 29. In addition, liners or bushings as at may also be disposed on the interior of the mounting channel 25', so as to protect against marring or other surface damage to the portion of the watercraft to which the mounting assembly 12 is attached. As further represented in FIG. 4, a variety of other connector or attachment structures may be utilized to complete the assembly as represented in FIG. 3. Also, hand manipulated knobs or like structures could be substituted for the locking screws 29 in order to further facilitate the removable attachment of the mounting assemblies 12 to various portions of the watercraft. Additionally, the mounting assemblies 12 may comprise a generally flat structure such that the mounting assemblies 12 may be attached to a generally flat or other similarly shaped surface or component of the watercraft.

As also represented in FIGS. 2 through 4, the adjustment assembly 14 comprises a receiving member, such as a tubular sleeve like member 30 having a substantially hollow interior 30' with a rotatable locking member 31, 32 secured to an open end thereof as at 33. The tubular sleeve like member 30 may be considered separate and distinct from the adjustment assembly 14. In either event, the receiving member or tubular sleeve like member 30 may be part of the attachment device 11. The dimension of the interior 30' is such as to receive a proximal end of different ones of the support arms 18 therein. Rotation of the locking members 31, 32 fitted about the open end 33 will serve to removably secure the distal ends of the respective support arms 18 on the interior 30' of the sleeve 30. As represented in FIG. 1, the support arms 18 will extend outwardly from the sleeve 30 of the adjustment assembly 14 in supporting relation to the cover member 22 along substantially all or at least the majority of the length of the support arms 18.

As set forth above, the mounting assembly 12 and the adjustment assembly 14 are rotationally, pivotally or otherwise movably interconnected to one another. Such rotational or otherwise movable connection is accomplished by a collar 35, adjustable, locking nuts 37 and appropriate dowels, connecting pins or like connectors 39 as represented. In addition, an activating member in the form of a lever type handle 36 is movably connected between the collar 35 and the base 25 and operatively engages inner and outer locking members 37 of the adjusting assembly 14. Selective and relative orientation of the sleeve like member 30 into any of a plurality of angular orientations relative to the mounting assembly 12, as well as the predetermined portion the watercraft to which it is attached, is accomplished by a manual manipulation of the lever 36 serving to release the locking members 37. This in turn permits the sleeve 30 to be rotated or pivoted into any of a variety of angular orientations relative to the substantially fixed mounting assembly 12 when it is secured to the watercraft.

Accordingly, each of the mounting assemblies 12 is movably and adjustably connected to different ones of a plurality of adjustment assemblies 14. Moreover, the sleeves 30, retaining the two support arms 18, may be correspondingly adjusted to vary the angular orientation thereof relative to the respective mounting assemblies 12, so as to vary the operative position of the cover assembly 16 and specifically, the cover member 22. Therefore, a shaded area generated by the cover member 22 may be extensively varied or repositioned by varying the angular orientation of the cover assembly 16 relative to the one or more mounting assemblies 12, as well as the substantially common portion of the watercraft to which the shade assembly 10 generally and the mounting assemblies 12 specifically, are removably secured.

Furthermore, the various movable components or parts of the present invention may be manually operated and/or electronically powered. For example, the support arm(s) 18 or other supporting structure may be movably disposable relative to the tubular sleeve like member 30. Accordingly, the support arm(s) 18 may be manually disposable or movable through or within member 30. However, as will be described in greater detail below with the other various embodiments of the present invention, and in particular with reference to FIGS. 26*b* and 27*b*, the present invention may include a motor or other various parts or components to facilitate, for example, the support arm(s) 18 to be electronically powered.

With primary reference to FIGS. 5 through 8, yet another preferred embodiment of the shade assembly of the present invention is generally indicated as 10'. As such, the shade assembly 10' comprises a cover assembly 16 including two spaced apart support arms 18, each at least partially supporting a flexible or other appropriate material cover member 22. As with the embodiment of FIG. 1, opposite edges or sides of the cover member 22 are connected to the support arms 18 and extend preferably along the entire length thereof or along at least a majority of such length. The inner or proximal ends of each of the support arms 18 are connected to a receiving member or channel 46 of the adjustment assembly generally indicated as 40 and shown in a detailed, unassembled form in FIG. 8.

Figure 5:
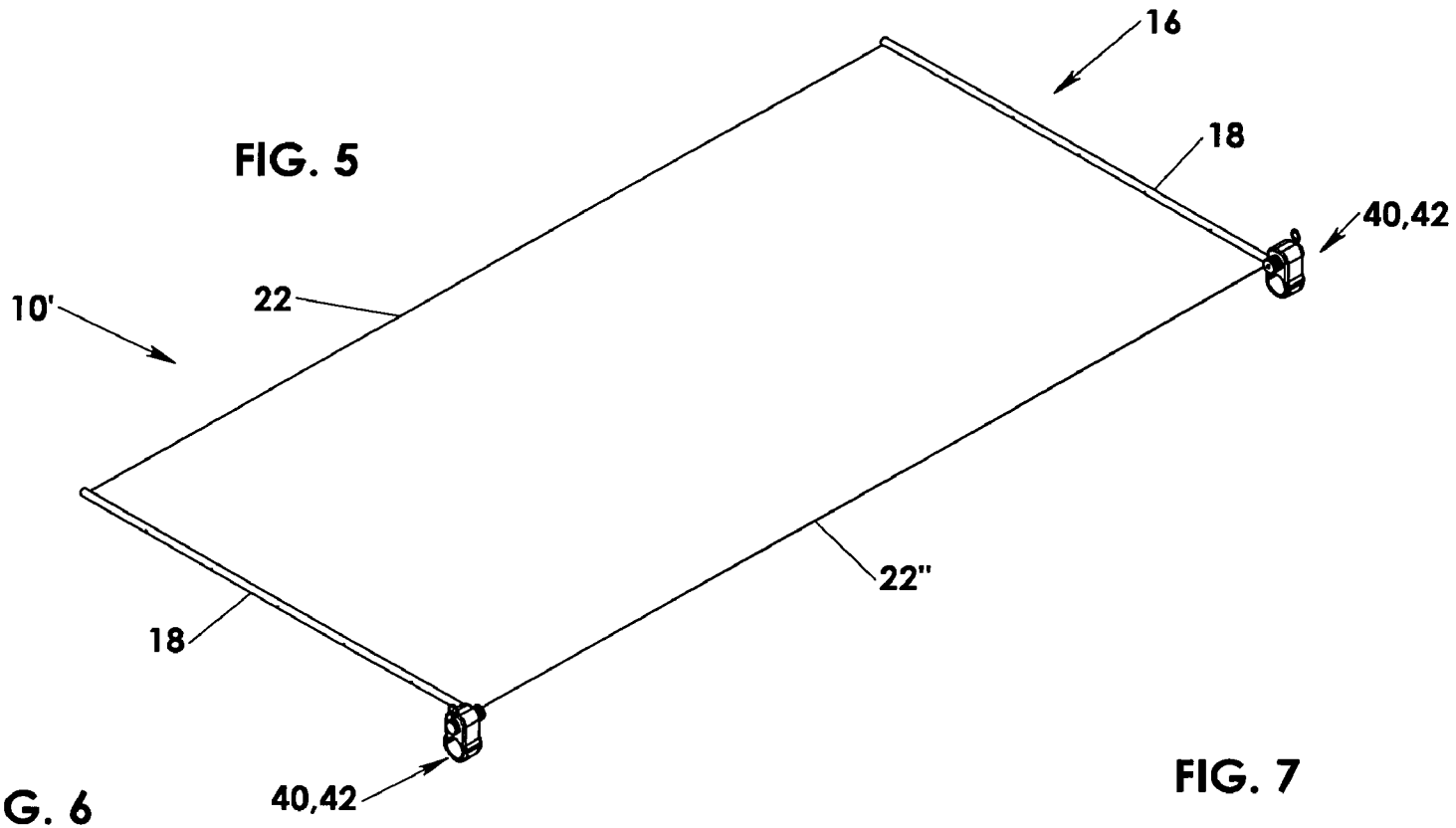
FIG. 5 is a perspective view of yet another preferred embodiment of the shade assembly of the present invention.
Figure 7:
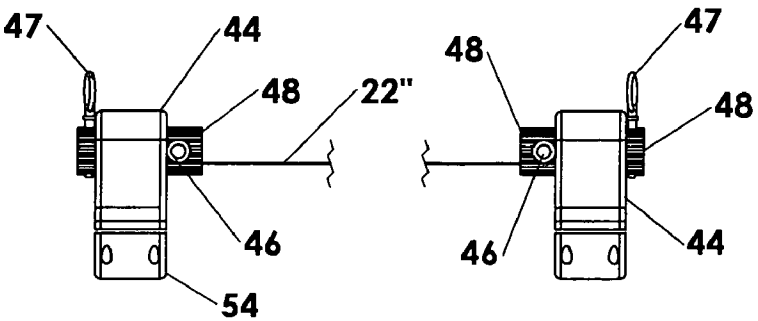
FIG. 7 is an end view in at least partially schematic form of a plurality of adjustment assemblies and mounting assemblies associated with the preferred embodiment of FIG. 5.
Figure 6:
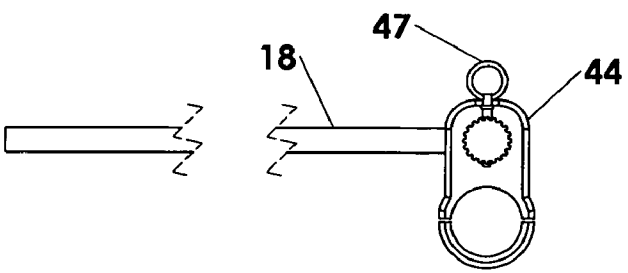
FIG. 6 is a sectional, interior view in partial cutaway of an adjustment assembly and mounting assembly associated with the embodiment of FIG. 5.

As distinguished from the embodiment of FIGS. 1 through 4, the adjustment assembly 40 is more directly associated with a mounting assembly generally indicated as 42 at least to the extent of being connected to or at least partially mounted within a common housing 44 of the attachment device 11'. Further, the proximal or inner most ends of each of the support arms 18 are removably secured into a receiving member or channel 46 formed in each of the adjustment members 48, which define an operative portion of the respective adjustment assemblies 40. With reference to FIGS. 5 through 7, the support arms 18 pass into the interior channels 46 and extend outwardly there from into the operative position demonstrated in FIG. 5.

Selective repositioning of the cover assembly 16, and in particular, the cover member 22 relative to the mounting assembly 42, occurs by a removal or detachment of the adjustment members 48 from the interior of the housing or base 44 of the adjustment assembly 40. More specifically, as clearly demonstrated in FIG. 8 the external surface 49 of each of the adjustment members 48 has a ribbed configuration which is disposed in a removable, mating engagement with ribbed interior surface configuration as at 49'. When in mating engagement, the ribbed surfaces 49 and 49' establish a relatively fixed connection which still allows a longitudinal displacement of the adjustment member 48, so as to remove the adjustment member 48 from the interior of the housing or base 44. Accordingly, when it is desired to change the angular orientation, and therefore, the operative position of the cover assembly 16 relative to the mounting assembly 42 as well as the housing or base 44, the adjustment member 48 is removed from the interior of the housing 44 so as to separate the ribbed surfaces 49 and 49'. When such attachment or separation occurs, the adjustment member 48 is rotated to accomplish the intended angular inclination or orientation of the support arms 18 which have their inner or proximal ends secured within the channels 46 of each of the adjustment members 48. Furthermore, the support arms 18 may be movably disposable relative to the channels 46. In addition, the support arms 18 may be manually operated and/or electronically powered.

Figure 8:
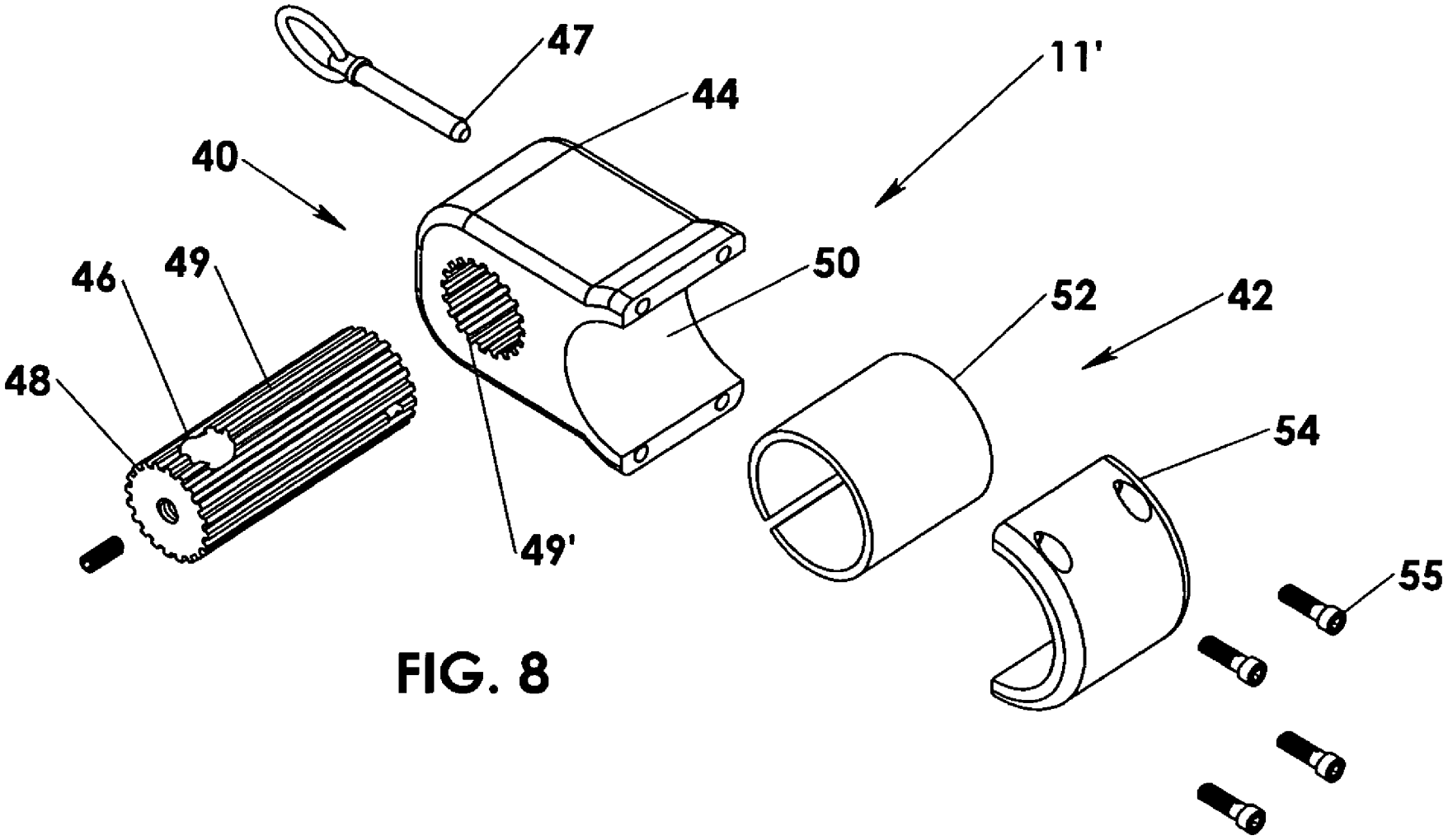
FIG. 8 is an exploded view of the adjustment assembly and mounting assembly of the embodiment of FIGS. 5 through 7 shown in represented in an unassembled form.

A removable pull pin or locking pin 47 passes through an appropriate channel formed in an outer most end of the adjustment member 48 so as to facilitate its connection to the base or housing 44 or its removal therefrom. When the locking pin 47 is in its connected position concurrently to the inner or proximal ends of the support arms 18 retained within channels 46, the adjustment member 48 is removably "locked" within the housing 44. Upon a desired change in the operative, protected position, and accordingly, the annular orientation of the cover member 22 relative to the base or housing 44, the locking pin is removed, as represented in FIG. 8, and the adjustment member 48 is detached from the base 44, so as to manually rotate it and thereby change its angular orientation, as set forth above. Furthermore, it is contemplated that the ribbed external surface 49 of the adjustment members 48 and the interior surface configuration 49' may be disposed in a partially "clicking" rotatable relation, such that complete removal of the adjustment members 48 for varied angular orientation of the shade assembly is not necessary. Moreover, as above, the various movable components or parts of the present invention may be manually operated and/or electronically powered. Accordingly, the adjustment member(s) 48 may be manually adjustable, as just described. However, the present invention may include a motor or other various parts or components to facilitate, for example, the adjustment member(s) 49 to be electronically powered and/or adjustable.

Additional structural features of the preferred embodiment of FIGS. 5 through 8 includes the mounting assembly 42 at least partially defining a mounting channel 50 at least partially dimensioned and configured to surround a tubular frame, such as that found on the frame of a t-top, or like frame support structure commonly associated with a variety of different marine craft. Similarly a liner or bushing 52 may be sandwiched within the channel 50 and retained therein by the clamp member 54 secured in overlying, at least partially surrounding relation to the liner or bushing 52 by a plurality of locking screws or like connectors. As with the mounting assemblies of the other preferred embodiments of the shade assembly of the present invention, the mounting assembly 42 may be quickly and easily disassembled for relocation and remounting or positioning of the shade assembly 10' on different portions of the watercraft. As a result, a shaded or otherwise protected area is produced in a desired location, based on the orientation and positioning of the watercraft relative to the sun or other factors affecting the exposure of exterior portions of the watercraft to other weather conditions.

Figures 8A, 8B, 8C:
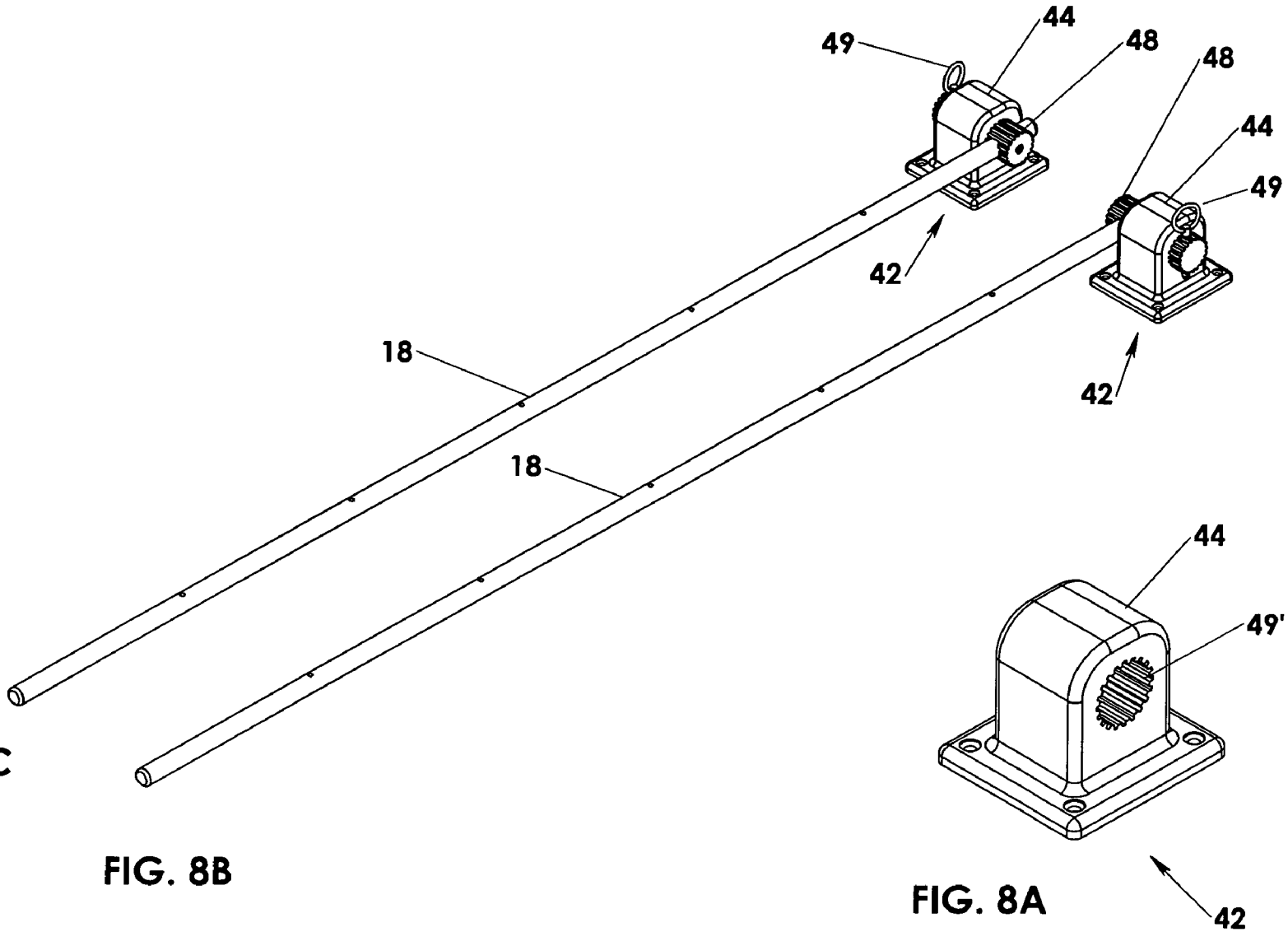
FIG. 8A is a sectional view of a structural variation of the mounting assembly of the embodiment of FIGS. 5 through 8.
FIG. 8B is a sectional view of a structural variation of the mounting assembly, adjustment assembly, and support arm of the embodiment of FIGS. 5 through 8.
FIG. 8C is another sectional view of a structural variation of the mounting assembly, adjustment assembly, and support arm of the embodiment of FIGS. 5 through 8.

A structural variation of the mounting assembly 42 of the embodiment of FIGS. 5 through 8 is shown in detail in FIGS. 8A, 8B, and 8C. Specifically, as with the mounting assemblies of the other preferred embodiments of the shade assembly of the present invention, the mounting assemblies 42 may comprise a generally flat or other like structure so as to attach the mounting assemblies 42 to a generally flat or similarly shaped structure or component of the watercraft.

Figure 9:
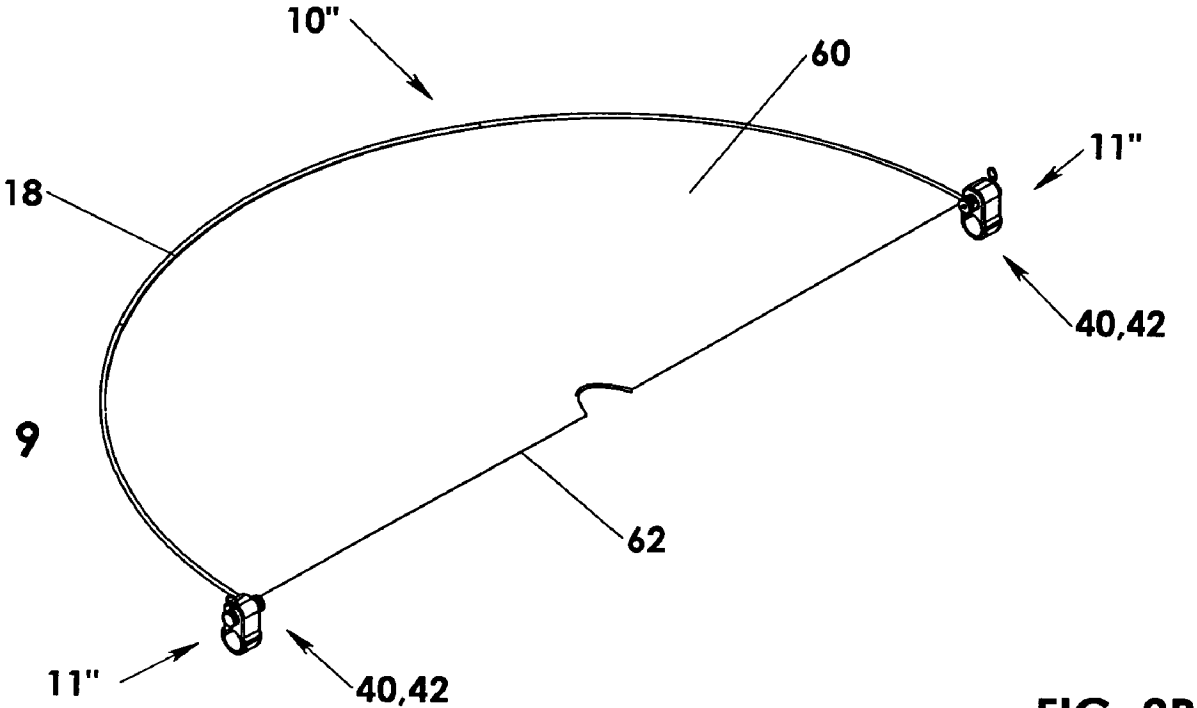
FIG. 9 is yet another preferred embodiment similar to that of FIGS. 5 through 8 including substantially equivalently structured adjustment assemblies and mounting assemblies.
Figure 11:
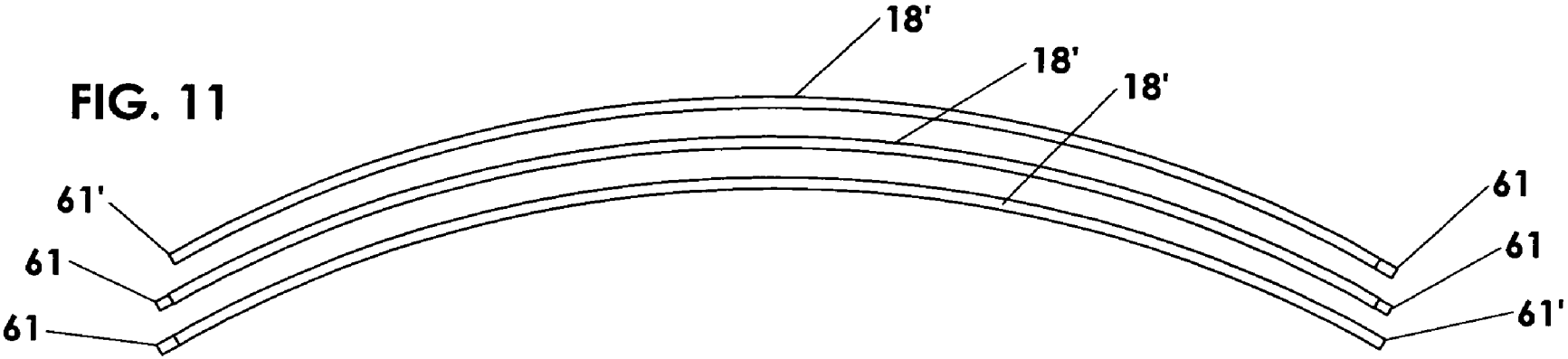
FIG. 11 is a top view of a plurality of arm segments of the type associated with the support arm of the embodiment of FIG. 9.
Figure 10:
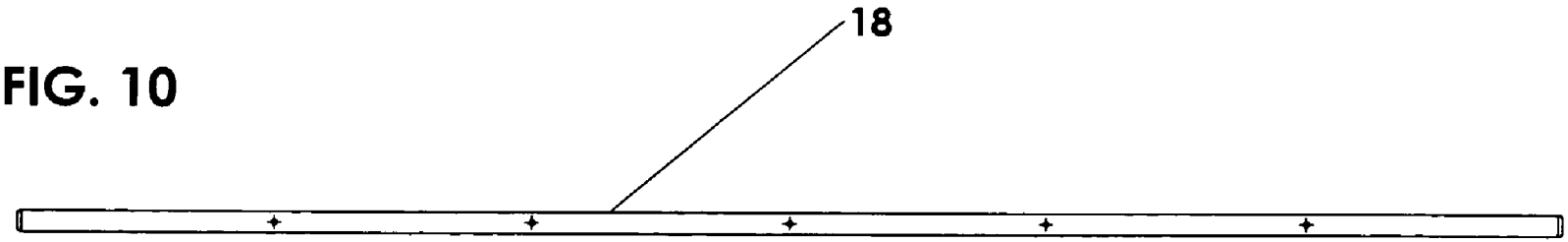
FIG. 10 is a side view of a support arm associated with the cover assembly of the embodiment of FIG. 9.

Another structural variation of the embodiments of FIGS. 5 through 8 is shown in detail in FIGS. 9 through 11, wherein the structural variation defines yet another preferred embodiment of the present invention. As such, the shade assembly 10" comprises a cover member 60 having a semi-circular or at least partially arcuate peripheral configuration supported by at least a single support arm 18. The single support arm 18 may be formed from a plurality of arm segments 18' as collectively represented in FIG. 11. The curved or at least partially arcuate configuration of each of the segments 18', defines the curved or arcuate configuration of the cover member 18 as represented in FIG. 9 when the segments 18' are each connected in an end to end relation to one another by telescopically and cooperatively structured end fittings 61 and 61'.

Accordingly, the single support arm 18, as defined by the plurality of interconnected arm segments 18' has its opposite ends each connected to a different one of the attachment devices 11" and/or adjustment assemblies 40, such as by a correspondingly position opposite end passing into and being retained by one of the receiving members or channels 46. As with the embodiment of FIGS. 5 through 8, the adjustment members 48 and the remaining components of the adjustment assembly 40 are substantially equivalent and/or identical to the adjustment assembly 40 as described in detail with regard to the embodiment of FIG. 9. Similarly, the mounting assembly 42 is equivalent or identically structured with the mounting assembly 42 associated with the embodiments of FIGS. 5 through 8 and FIG. 9.

Figure 9B:
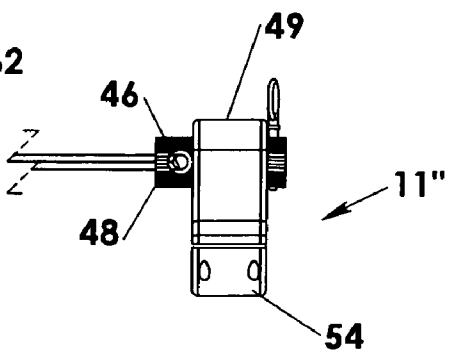
FIG. 9B is an end view in partial cutaway and schematic form of a plurality of adjustment and mounting assemblies associated with the embodiment of FIG. 9.
Figure 9A:
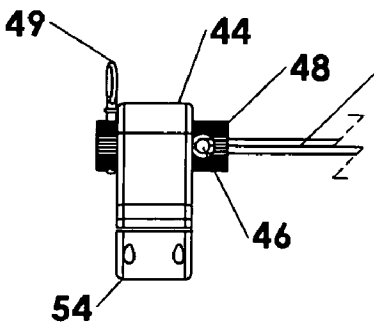
FIG. 9A is a sectional view in partial cutaway of an adjustment assembly and mounting assembly associated with the embodiment of FIG. 9.
Figure 9A:
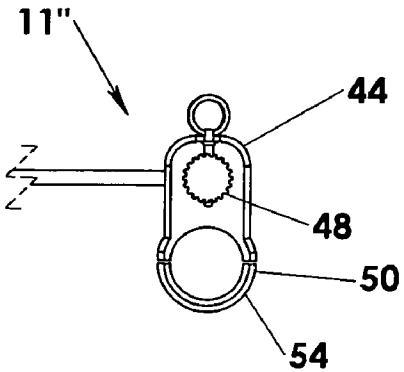
Figure 9A:
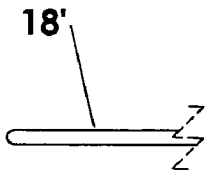

In addition, a bracing or reinforcing rod 62 may be disposed in interconnecting relation between aligned ones of the adjustment members 48 associated with each of the spaced apart adjustment assemblies 40 as best shown in FIGS. 9 and 9B.

Figures 12, 12A, 12B:
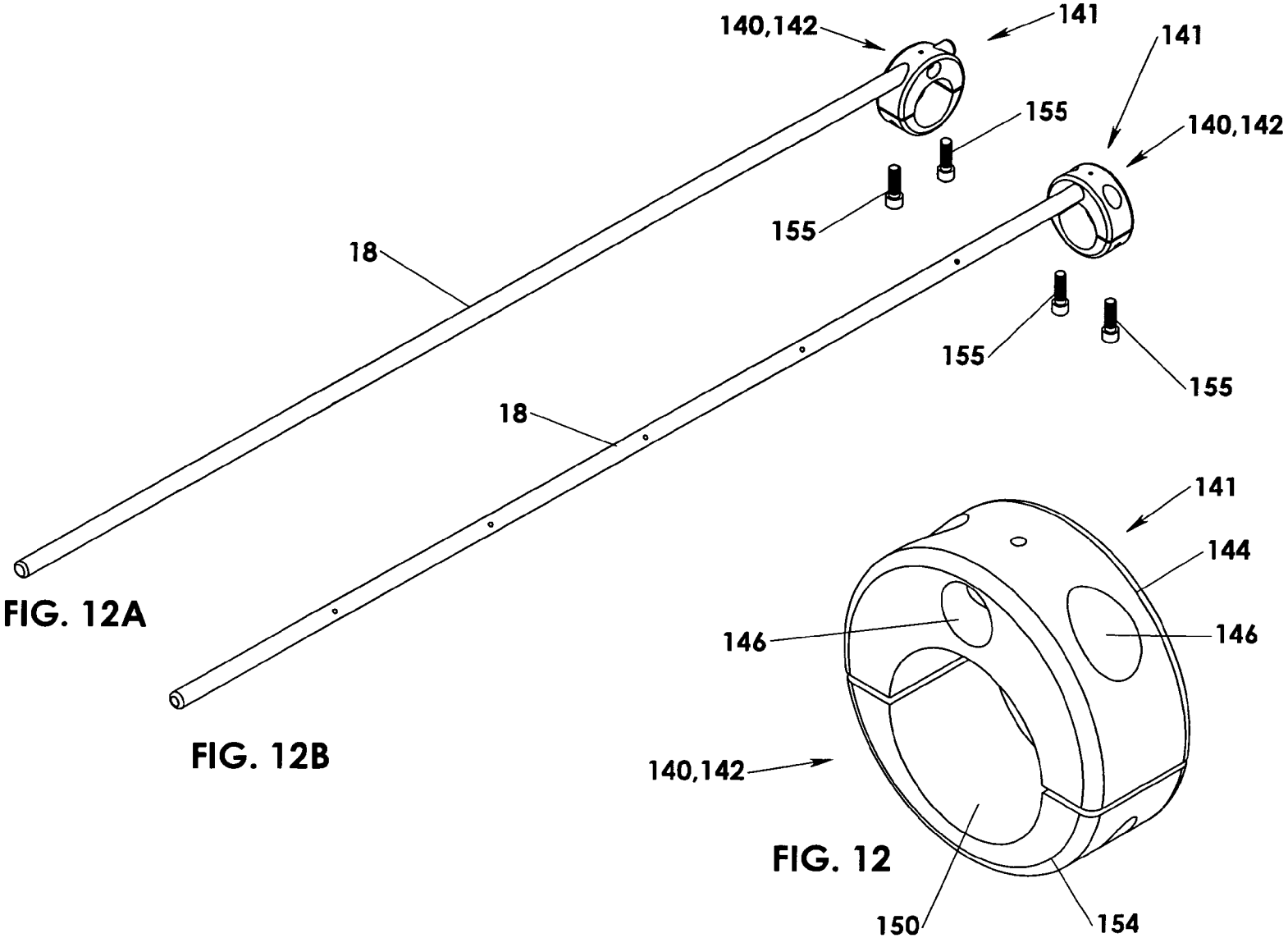
FIG. 12 is a perspective view of the exterior of the adjustment assembly and mounting assembly of one preferred embodiment.
FIG. 12A is a perspective view of the support arm, adjustment assembly, and mounting assembly of the preferred embodiment of FIG. 12.
FIG. 12B is another perspective view of the support arm, adjustment assembly, and mounting assembly of the preferred embodiment of FIG. 12.
Figure 13:
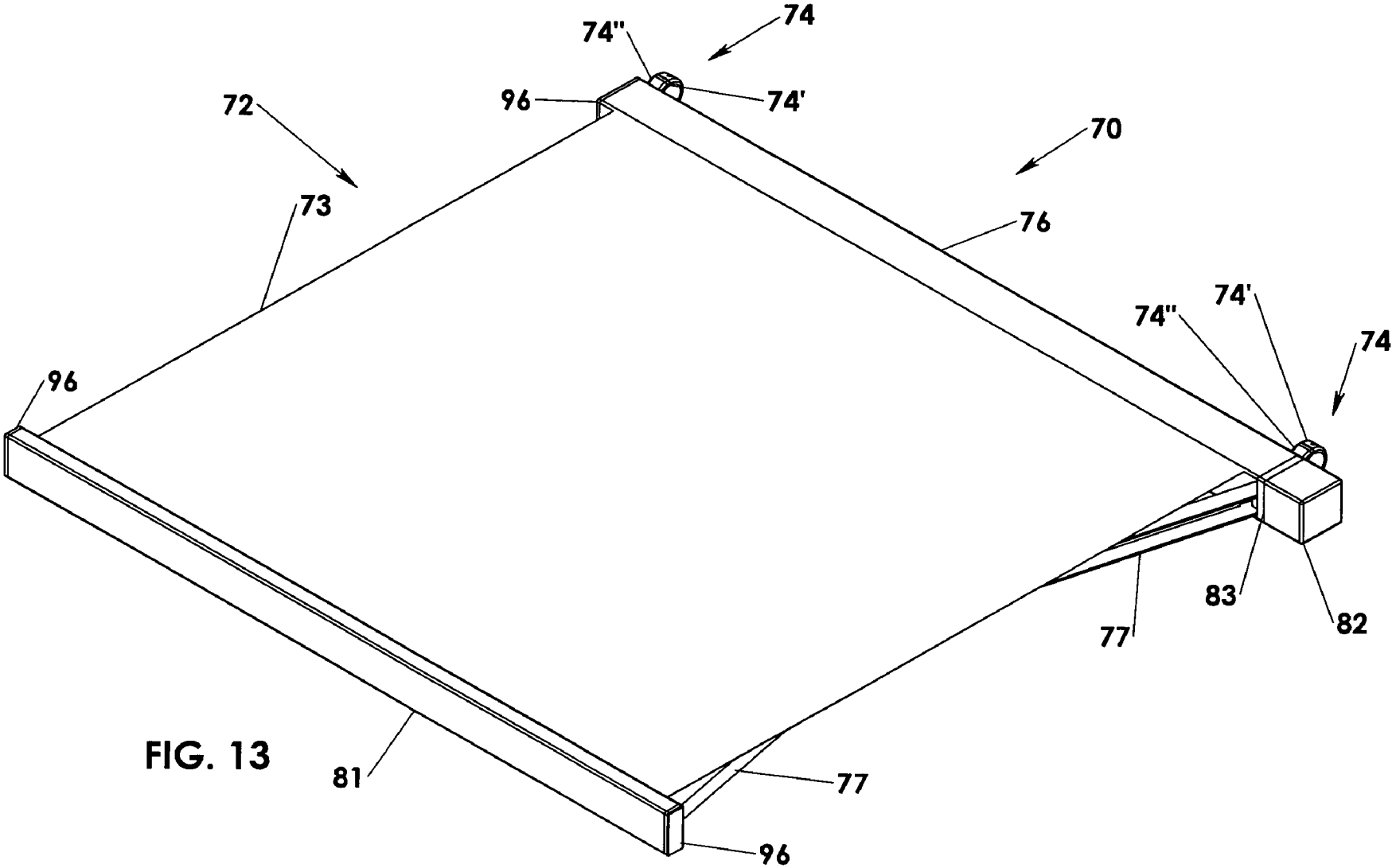
FIG. 13 is a top perspective view of yet another preferred embodiment of the shade assembly of the present invention.
Figure 14:
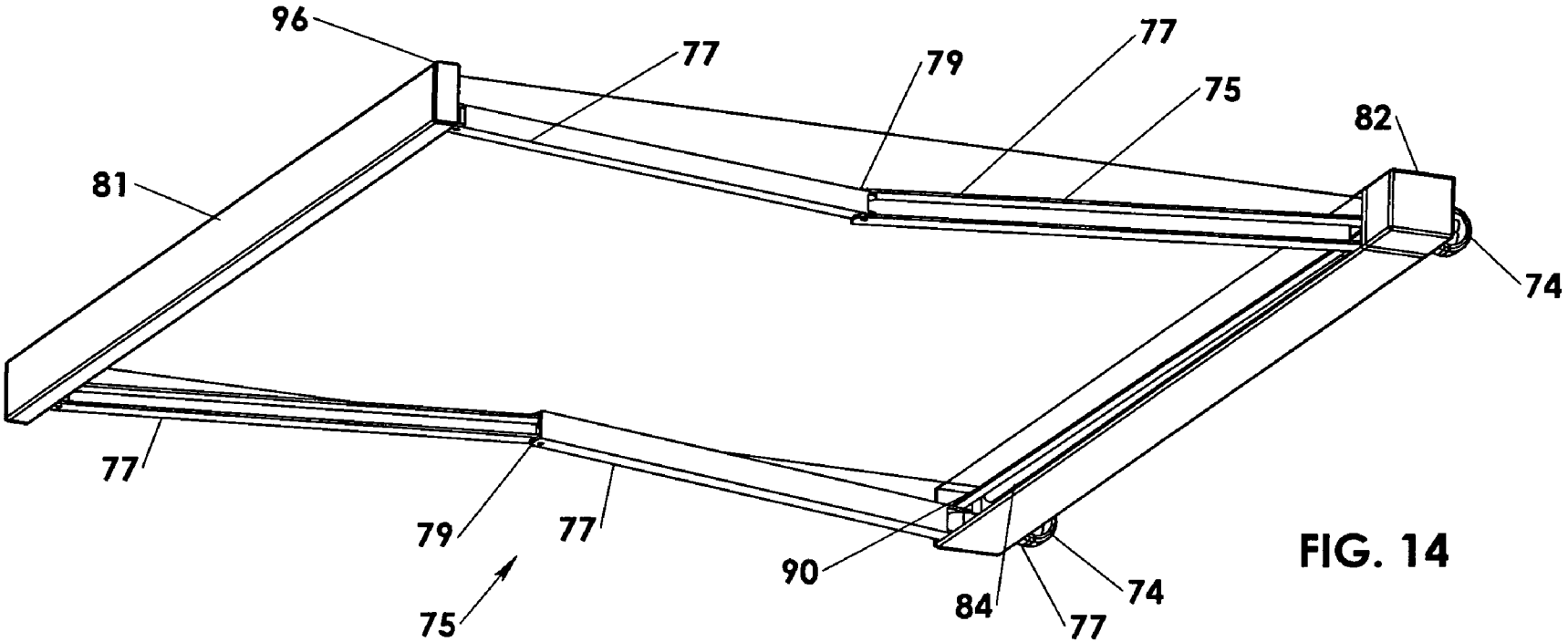
FIG. 14 is a bottom perspective view of the embodiment of FIG. 13.

With primary reference to FIGS. 12, 12A, and 12B, yet another preferred embodiment of the shade assembly of the present invention is shown. As distinguished from the embodiment of FIGS. 5 through 8, the attachment device 141 includes an adjustment assembly 140 which structurally corresponds to the mounting assembly, generally as indicated as 142. As shown in FIG. 12, the adjustment assembly 140 and the mounting assembly 142 share a common housing 144, and for the purposes of this embodiment only, are structurally the same. Furthermore, as shown in FIGS. 12A and 12B, the proximal or inner most ends of each of the support arms 18 are removably secured to a receiving member or channel 146. Additionally, the adjustment assemblies 140 include two channels 146 whereby the proximal or inner most ends of the support arms 18 may be secured or disposed either laterally, as shown in FIG. 12A, or transversely, as shown in FIG. 12B, relative to the adjustment assembly 140.

Selective repositioning of the cover assembly, and in particular the cover member relative to the mounting assembly 142 occurs by the loosening or removal of a clamp member 154 of the mounting assembly 142 and adjustment assembly 140. Moreover, the clamp member 154 may be secured to the housing 144 with a plurality of cap screws 155. Once the clamp member is loosened or removed, the adjustment assembly 142 may be selectively rotated to accomplish the intended angular inclination or orientation of the support arms 18 which have their inner or proximal ends secured within the channels 146 of each of the adjustment assemblies 140. Furthermore, a set screw passes through an appropriate channel formed in the upper most end of the adjustment assembly 140 to secure the support arm 18 therein.

Additional structural features of the preferred embodiment of the FIGS. 12, 12A, and 12B, include the mounting assembly 142 at least partially defining a mounting channel 150 at least partially dimensioned and configured to surround a tubular frame, such as that found on the frame of a t-top, or like frame support structure commonly associated with a variety of different marine craft. As with the mounting assemblies of the other preferred embodiments of the shade assembly of the present invention, the mounting assembly 142 may be quickly and easily disassembled for relocation and remounting or positioning on different portions of the watercraft. As a result, a shaded or otherwise protected area is produced in a desired location, based on the orientation and positioning of the watercraft relative to the sun or other factors affecting the exposure of exterior positions of the watercraft to other weather conditions. Further, as with the mounting assemblies of the other preferred embodiments of the shade assembly of the present invention, and in particular with reference to FIGS. 8A, 8B, and 8C, the mounting assemblies 142 may comprise a generally flat or other like structure so as to allow attachment of the mounting assemblies 142 to a generally flat or other similarly shaped structure or component of the watercraft.

Additionally, as above, the various movable components or parts of the present invention may be manually operated and/or electronically powered. For example, the support arm (s) 18 or other supporting structure may be movably disposable relative to the channel(s) 146. Accordingly, the support arm(s) 18 may be manually disposable or movable therein. However, as will be described in greater detail below with the other various embodiments of the present invention, and with particular reference to FIGS. 26*b* and 27*b*, the present invention may include a motor or other various parts or components to facilitate, for example, the support arm(s) 18 being electronically powered.

Yet another preferred embodiment of the shade assembly is represented in FIGS. 13 through 16 and is generally indicated as 70. More specifically, the shade assembly 70 includes a cover assembly generally indicated as 72 and one or more attachment devices 71 having one or more mounting assemblies generally indicated as 74. Each of the mounting assemblies 74 are removably or fixedly attached, at least in part, to a receiving member or housing 76 which retains at least a portion of the adjustment assembly 78 shown in more detail in FIG. 16.

Generally similar to the above described embodiments, each of the mounting assemblies 74 comprises clamp-like mounting members 74' and 74". The members 77 are secured to the housing 76 and are cooperatively structured for interconnection with the outer most locking member 77' to form a tubular or other preferred shape receiving channel 80 on the interior thereof. This tubular channel 80 is dimensioned and configured to receive and removably but firmly engage various types of tubular or other shaped frame members, as well as other portions of the watercraft. Interconnecting screws or the like serve to close the clamp members 74' and 74" into a gripping relation to the common, predetermined portion of the watercraft on which the shade assembly 70 is mounted or connected. Additionally, as with the mounting assemblies of the other preferred embodiments of the shade assembly of the present invention, the mounting assemblies 74 may comprise a generally flat or other like structure so as to allow attachment of the mounting assemblies 74 to a generally flat or other similarly shaped structure or component of the watercraft. Further, the shade assembly 70 and the mounting assemblies 74 may be structured and disposed so as to be integrated with or within a structure on a watercraft, for example, the shade assembly 70 may be integrated within a partial shade assembly or rear deck of a yacht.

As will also be explained in greater detail hereinafter the adjustment assembly 78 includes, in at least one structural modification or embodiment, a drive motor 83 which may be electrically powered and housed within an end cap like enclosure 82. The drive motor 83 is drivingly connected to a spindle as at 84 on which the flexible material cover member 73 may be stored. Accordingly, activation of the drive motor 83 serves to rotate the spindle 84 in either direction so as to allow an outward extension of the cover member 73 or a retraction thereof back about the spindle 84 in a non-operative or stored orientation. When in such a stored orientation, the cover member 73 may be retained on the interior of the housing 76. The adjustment assembly 78 is further structured to drive or operatively position the support arm 75. Each of the support arms 75 comprises a plurality of at least two arm segments 77 pivotally connected to one another along intermediate portions 79. Further, the outer or distal end of each of the support arms 75 is secured to an end member 81, wherein the inner or proximal ends of each of the support arms 75 are connected to a driving portion of the adjustment assembly 78. Accordingly, upon activation of the adjustment assembly 78 the support arms 75 are forced outwardly by being extended or are forced inwardly as by being folded and retracted. Due to the fact that the cover member 73 is at least partially supported between the housing 76 and the end member 81, it will extend outwardly from the housing 76 or be retracted back into the housing 76 depending upon a particular and preferred operative position desired.

Figure 15:
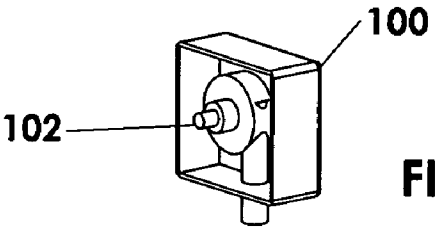
FIG. 15 is a perspective detail view of a structural modification including a drive assembly which may be incorporated in the preferred embodiment of FIGS. 13 and 14.
Figure 16A:
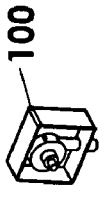
FIG. 16A is a perspective view of a structural modification, including a drive assembly, similar or equivalent to the embodiment of FIG. 15, which may be incorporated in the embodiment of FIG. 16.
Figure 16:
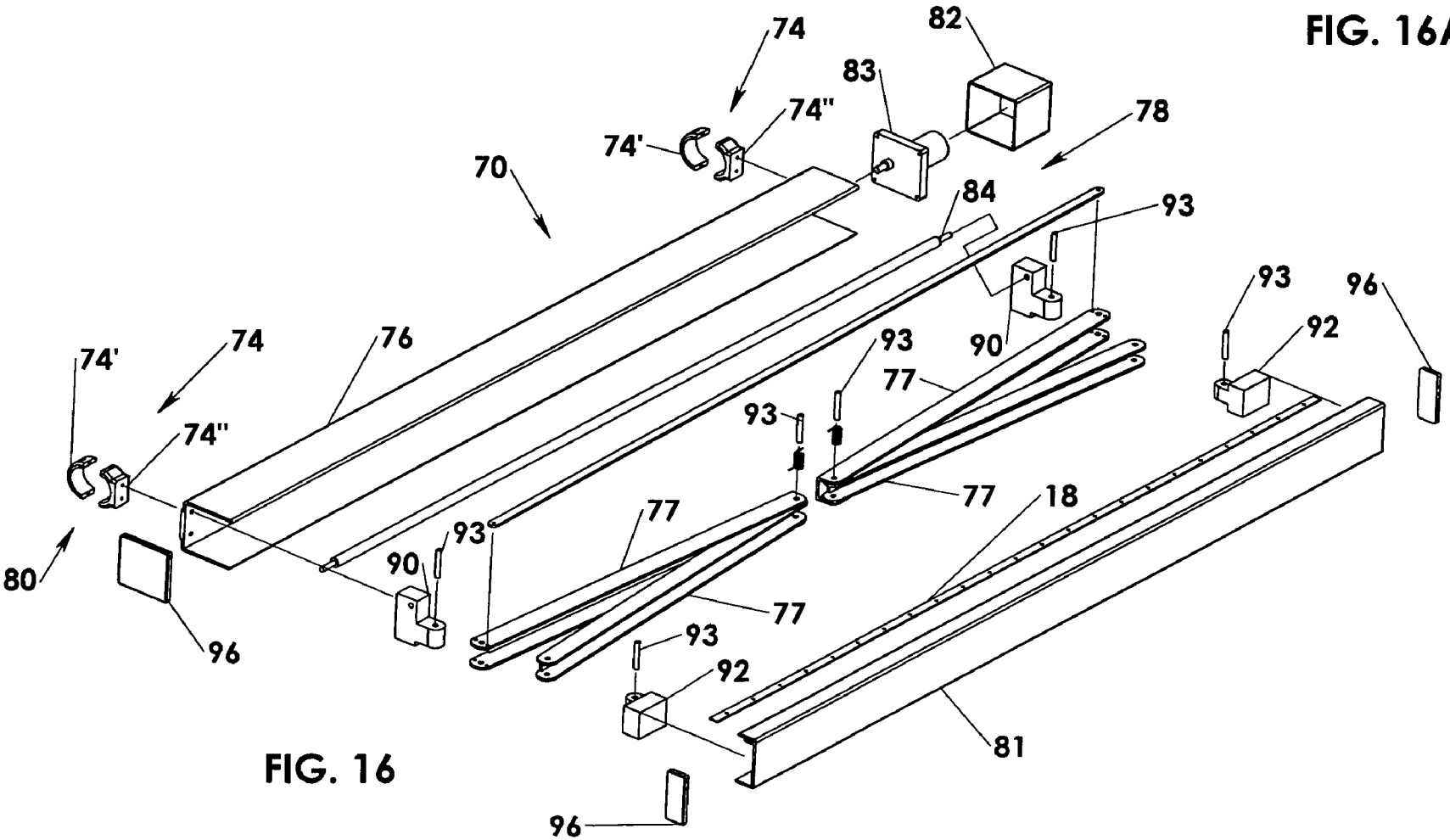
FIG. 16 is an exploded view of the various operative components of the embodiment of FIGS. 12 through 14 in an unassembled form.

Folding or pivotal movement of the arm segments 77 is accomplished by the provision of pivot blocks and like mounting structures as at 90 and 92, wherein corresponding ends of the arm segments are pivotally attached to the pivot blocks 90, 92 by pivot pins 93. Enclosure tabs 96 may overly the opposite ends of the end 81 for purposes of enclosing and at least partially protecting one or more of the pivot blocks 90 and 93 as well as the pivotal connection with the arm segments 77. Yet additional structural modifications of the shade assembly 70 as represented in FIGS. 15 and 16A and include an adaptor portion generally indicated as 100 which is connected to or serves as a replacement part for the powered drive assembly 83. As such, the adaptor portion 100 serves to permit manual actuation of the drive assembly by including an outwardly projecting finger as at 102 structurally adapted to receive a crank arm or like structure to facilitate manual positioning of the cover assembly 70 into and out of anyone of a plurality of operative position.

As with the previously described embodiments the shade assembly 70 is therefore expandable outwardly from at least one predetermined portion of the watercraft to which it is attached so as to generate shade as well as provide other protection from addition weather conditions over or about exterior deck portions or other exterior portions of the watercraft to which the shade assembly 70 is attached In a most preferred embodiment of the present invention, as shown in FIGS. 17 through 25 the shade assembly 210 may include an attachment device 220 structured to operatively connect a cover assembly 230 to at least one predetermined portion of the watercraft.

In the embodiment shown in FIGS. 17 through 25, the shade assembly 210 of the present invention preferably includes two, spaced-apart attachment devices 220 connected to predetermined portions of the watercraft. However, as will be described in greater detail below, the attachment device(s) 220 may be integrated within at least one portion of the watercraft, rather than being removably connectable thereto.

Figure 18:
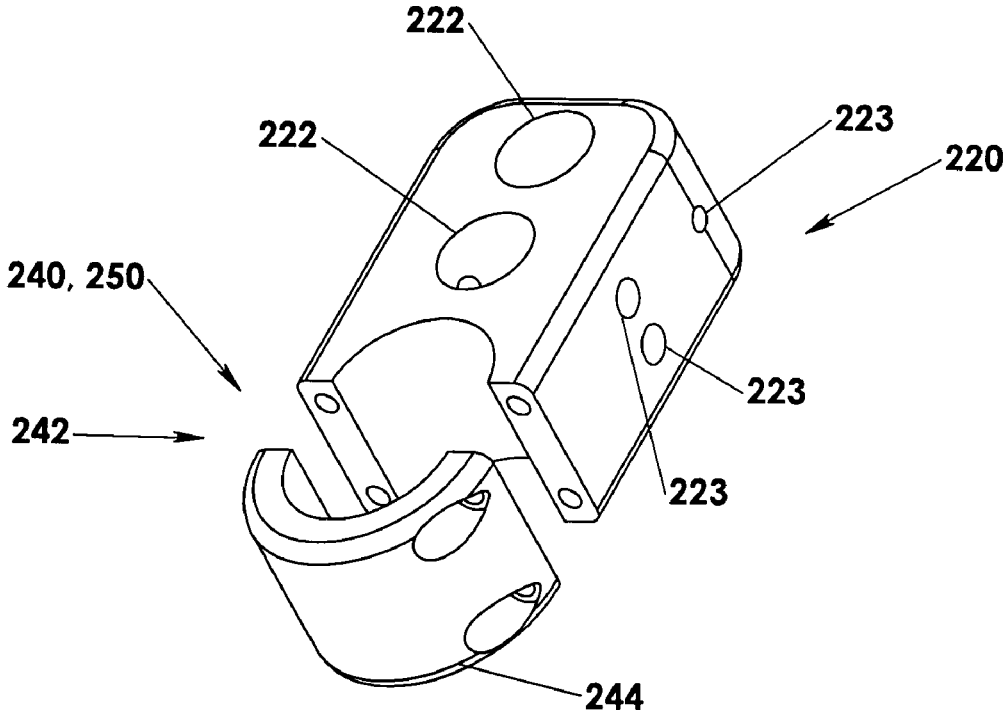
FIG. 18 is a perspective schematic representation of one embodiment of the attachment device of the shade assembly of FIGS. 17 and 17*a*.
Figure 18A:
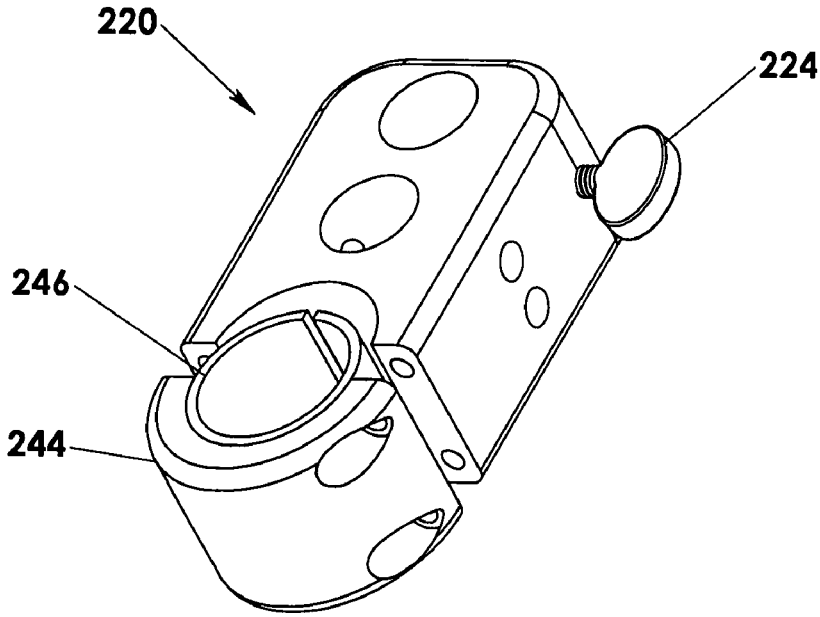
FIG. 18*a* is another perspective view of the attachment device of FIG. 18.

Referring now to FIGS. 18 and 18*a*, the attachment device (s) 220 of the present invention may be structured in a plurality of sizes, shapes, and/or dimensions to facilitate the intended use of the shade assembly 210 of the present invention. Moreover, the attachment device 220 may include one or more receiving members 222. As will be described below, the receiving members 222 may be cooperatively structured holes, cavities, or tube-like structures to accept or receive at least a portion of the cover assembly 230 therein.

Figure 18B:
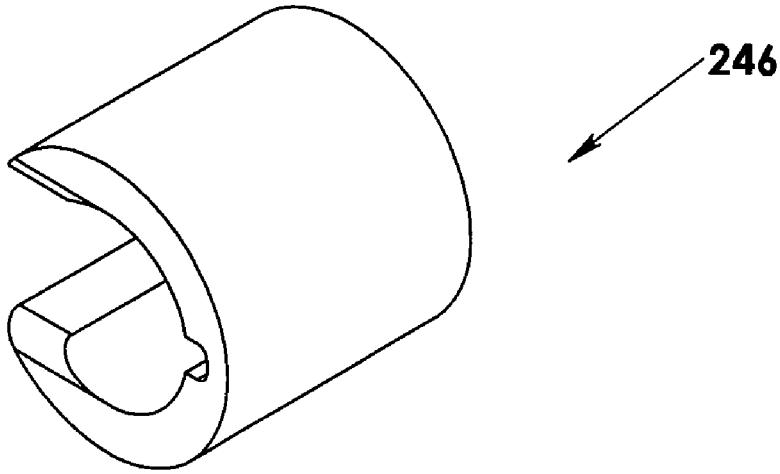
FIG. 18*b* is a schematic representation of a bushing associated with the embodiment of the attachment device of FIG. 18*a*.
Figure 18C:
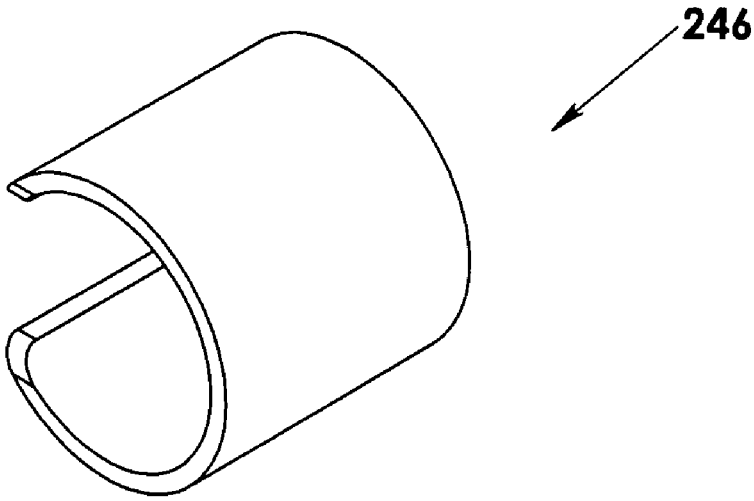
FIG. 18*c* is a schematic representation of a variation of the bushing of FIG. 18*b*.

Furthermore, with reference to FIGS. 18 and 18*a*, the attachment device 220 may include a mounting assembly 240 structured to facilitate the attachment or securing of the attachment device 220 to the watercraft. The mounting assembly 240 may include a mounting channel 242 or interior area at least partially defined by a removable, or otherwise adjustable clamp 244. The clamp 244 may be secured into an assembled position, for example, by set or locking screws. In addition, liners or bushings 246 may be disposed on the interior of the mounting channel 242 so as to protect against surface damage to the portions of the watercraft. As shown in FIGS. 18*b* and 18*c*, the bushings 246 may comprise different shapes, thicknesses, and sizes depending on the particular use.

Figure 19:
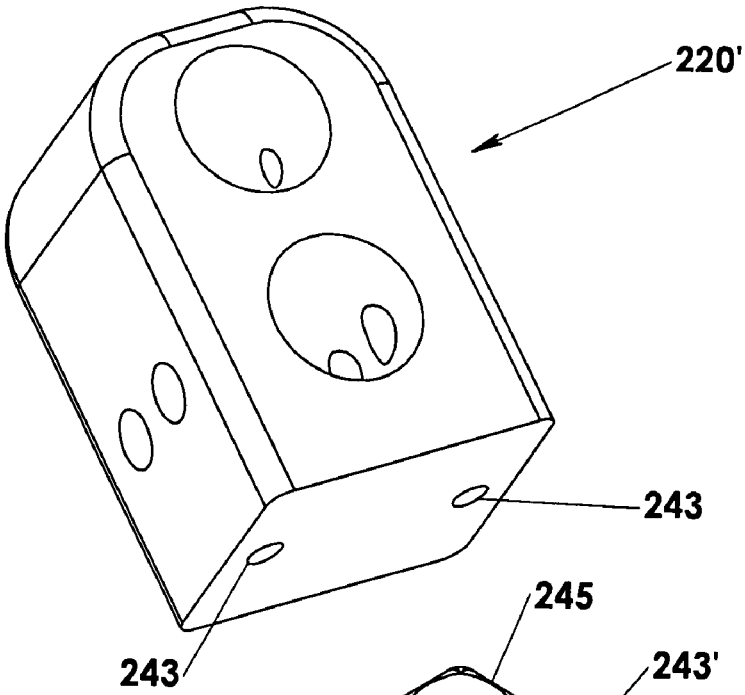
FIG. 19 is schematic representation of another preferred embodiment of the attachment device of the shade assembly.
Figure 19A:
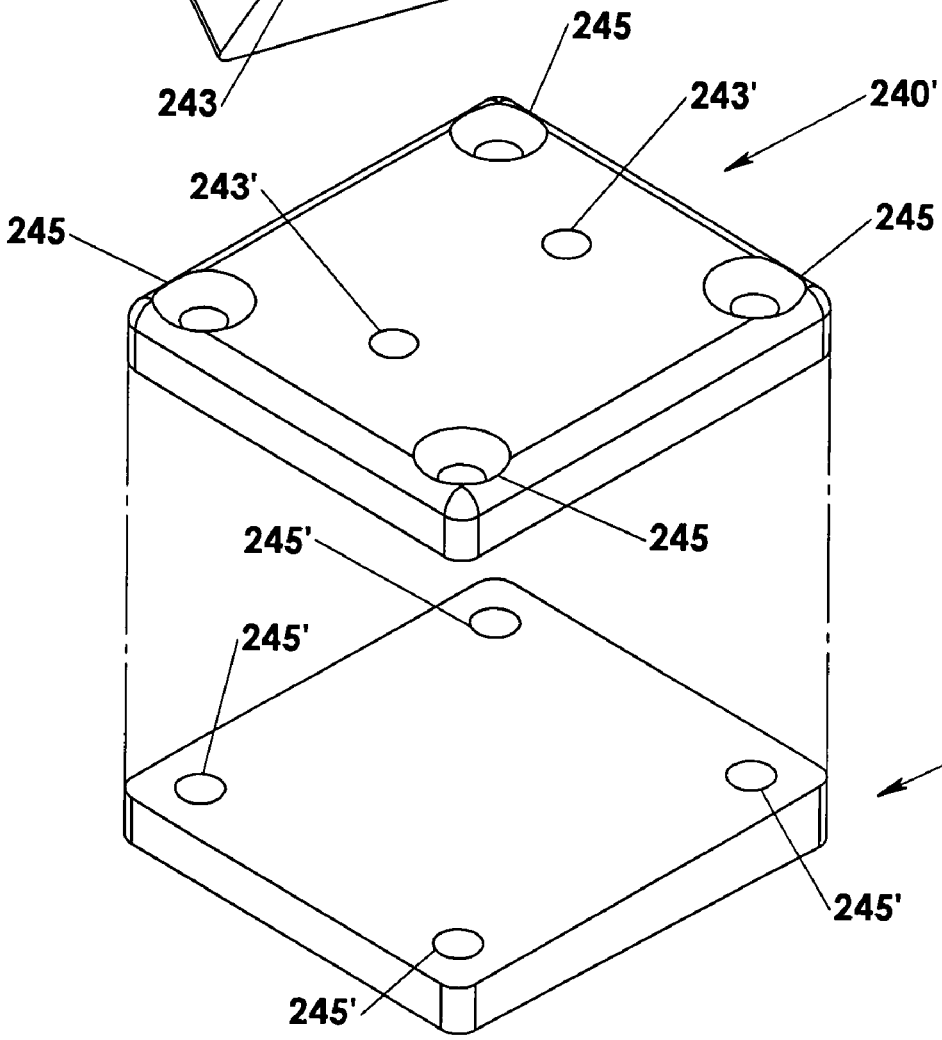
FIG. 19*a* is an exploded schematic representation of a mounting assembly for the attachment device of FIG. 19.

In addition, as illustrated in FIGS. 19 and 19*a*, another embodiment of the mounting assembly 240' for the attachment device 220' may include an at least partially flat base 241. The attachment device 220 and the base 241 may include cooperatively structured and disposed holes 243 and 243', respectively. Accordingly, screws, tacks, or other securing devices may be utilized to securely connect the attachment device 220' to the base 241. Furthermore, the base 241 may comprise a plurality of holes or bores 245 structured to facilitate the attachment thereof to the predetermined portion of the watercraft. Such a predetermined portion of the watercraft may preferably be hard and/or partially durable, such as hard radar arch, "t-top", or "bimini-top" of the type indicated as 200 in FIG. 17*a*.

Additionally, the mounting assembly 240' may comprise one or more angled shims 247, as illustrated in FIG. 19*a*. The shims 247 may be structured to be disposed between the base 241 and the predetermined portion of the watercraft to which the base 241 is secured. Because many surfaces or portions of a watercraft may not be substantially level, the angled shims 247 may be structured to facilitate the attachment assembly 220' to be mounted or otherwise attached in a horizontal or level orientation relative to the watercraft. Accordingly, the angled shims 247 may include cooperatively structured and disposed holes or bores 245' so as to line up with the holes or bores 245 of the base 241, as shown in FIG. 19*a*.

The attachment device 220, need not, however, include a mounting assembly 240. As will be described in greater detail below, in such an embodiment, the attachment device 220 and the receiving member 222 may be structurally integrated or embedded with predetermined portions of the watercraft. For exemplary purposes only, the attachment device 220 and the receiving structure 222 thereof, may include a channel or bore embedded within or otherwise fixedly attached to the radar arch, "t-top", "bimini-top", or other like portions of the watercraft, including but not limited to overhangs, ceilings, or other fixed portions. Accordingly, the cover assembly 230, and in particular, the support arms 232 and/or the connecting support arms 236 may be retractably disposable within the structurally integrated attachment device 220.

Figure 20:
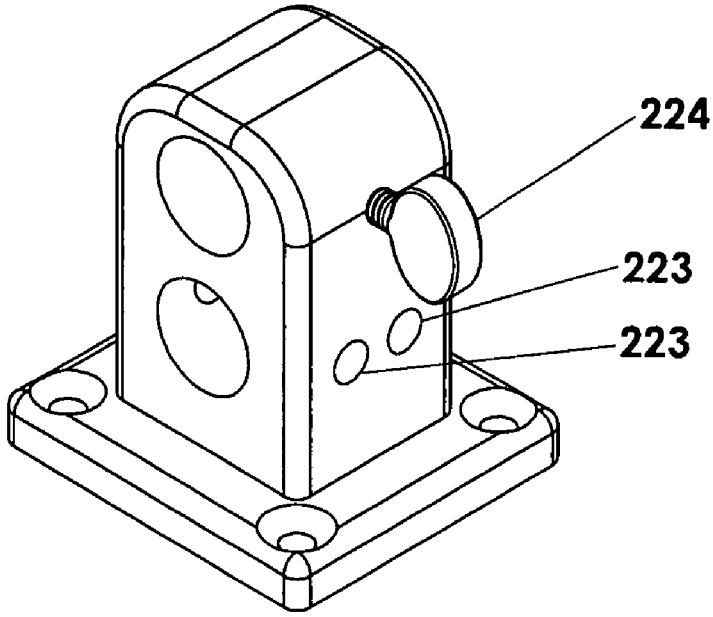
FIG. 20 is a perspective view of the attachment device of the embodiment of FIGS. 19 and 19*a* without an angled shim.
Figure 20A:
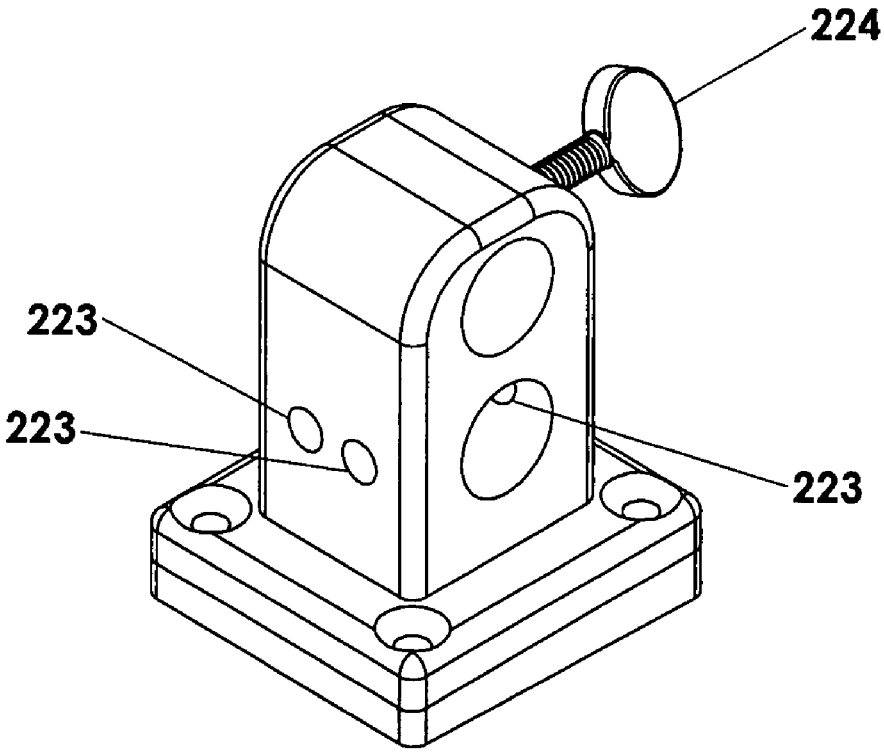
FIG. 20*a* is a perspective view of the attachment device of the embodiment of FIGS. 19 and 19*a* including an angled shim.
Figure 20B:
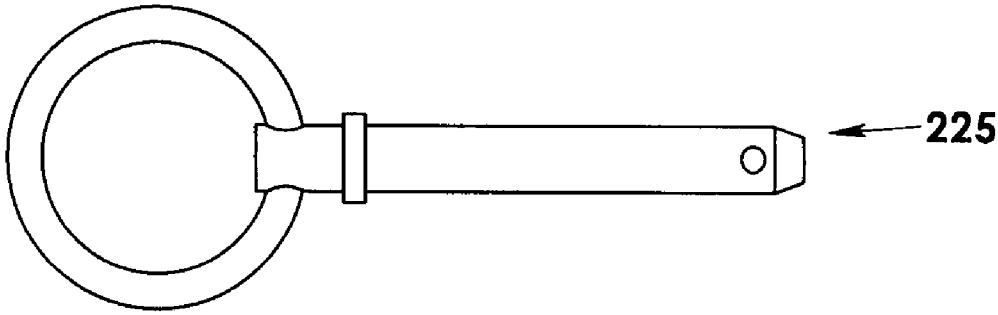
FIG. 20*b* is a side view of a pull pin associated with at least one embodiment of the present invention.
Figure 20C:
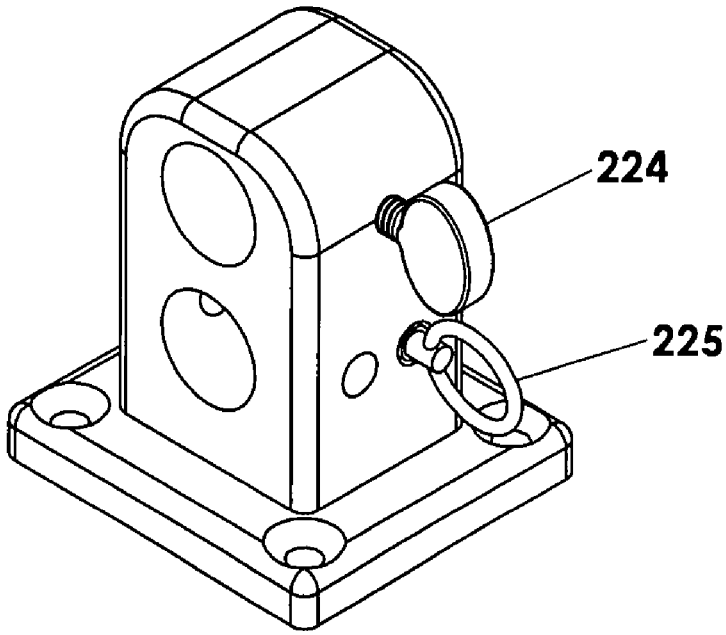
FIG. 20*c* is a perspective view of the attachment device of the embodiment of FIGS. 19 and 19*a* including the pull pin as represented in FIG. 20*b*.

Furthermore, as shown in FIGS. 20 through 20*c*, the attachment device 220 may include one or more holes or bores 223 cooperatively structured and disposed to facilitate a thumb screw 224, a pull pin 225, or other securing devices to pass therethrough. Accordingly, a thumb screw 224, pull pin 225, or other like device, may pass through the hole 223 and come into engaging contact with a portion of the cover assembly 230. The thumb screw 224, pull pin 225, or other device may pass through the surface of the portion of the cover assembly 230. However, the securing device may merely come into engaging contact with the surface and be held into place at least by frictional force, an indentation, or the like.

As with many of the other embodiments of the present invention described above, the attachment device 220, 220' may include an adjustment assembly 250. The adjustment assembly 250 in the embodiment of FIGS. 17 through 25, is structurally identical to the mounting assembly 240. Accordingly, in order to adjust the operative angled orientation of the shade assembly 210 of the present invention, the adjustment assembly 250 may be loosened to orient the attachment device 220 relative to the predetermined portion of the watercraft.

Additionally, referring again to FIG. 17*a*, the cover assembly 230 of at least one preferred embodiment of the present invention may include at least one supporting structure 231 and a cover member 238. The supporting structure 231 may comprise a base, frame or other similar device structured to support the cover member 238, at least to facilitate the practice of the present invention in the intended fashion. In addition, similar to the embodiments described above, the supporting structure 231 may include one or more support arms 232 disposed in at least partially supporting relation to the cover member 238. Moreover, the support arms 232 may include a proximal end 233 operatively disposed proximate to a predetermined portion of the watercraft, and an oppositely disposed distal end 234. The proximal end 233 of the support arms 232 may be disposable within a cooperatively structured receiving member 222 of the attachment device 220. Accordingly, in at least one preferred embodiment, the shade assembly 210 may include at least one support arm 232 for each attachment device 220, wherein the proximal end 233 of each support arm 232 may be removably connected to, or slidingly engaged with, the receiving member 222 of each attachment device 220. Furthermore, the attachment device 220 may be structured to dispose the support arms 232, or other supporting structure 231, in an at least partially stored position. As such, the support arms 232 may be disposed substantially proximate to and/or parallel to the predetermined portion of the watercraft when not in use.

Figure 17:
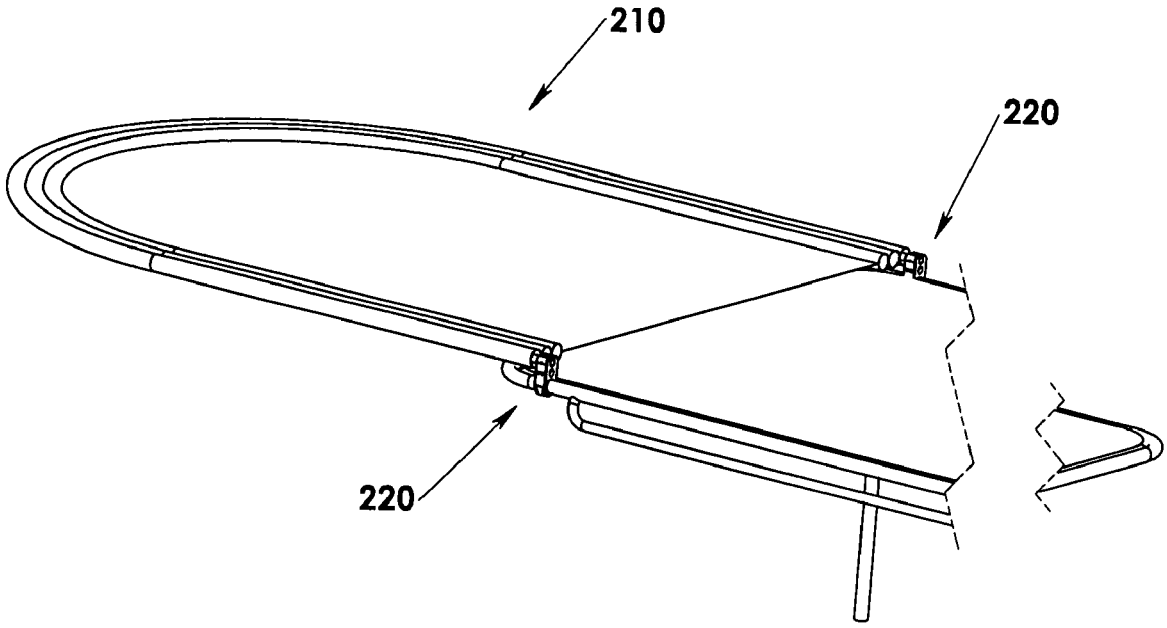
FIG. 17 is another perspective view of one preferred embodiment of the shade assembly of the present invention.
Figure 17A:
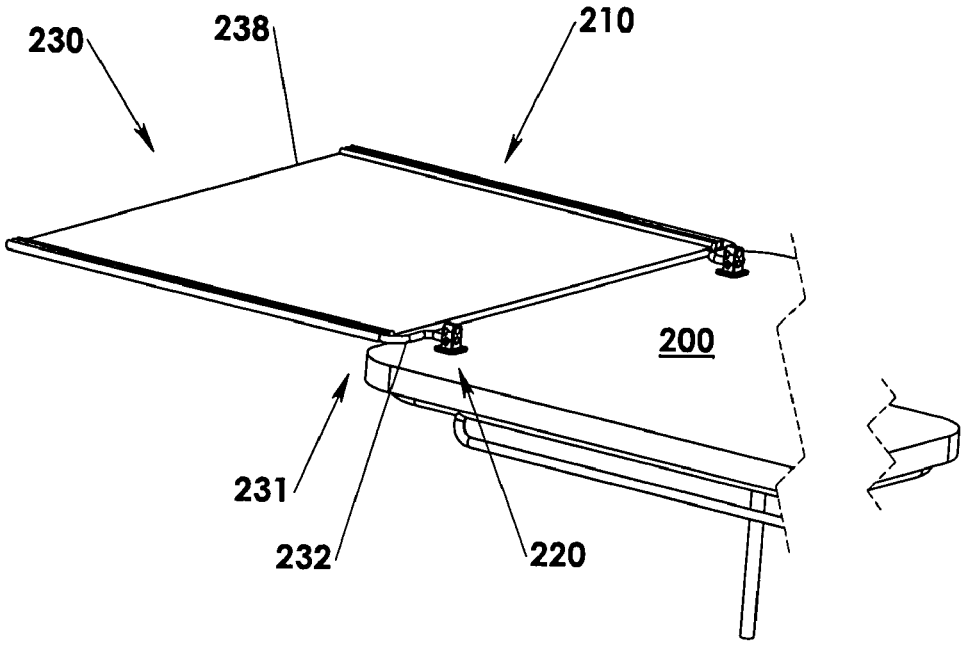
FIG. 17*a* is a perspective view of a variation of the preferred embodiment of the shade assembly of FIG. 17.

In addition, as shown in FIG. 17*a*, the support arm 232 may include an at least partially "bent", s-like, or other appropriate and predetermined configuration at or near the proximal end 233 thereof. The predetermined or "bent" configuration is such as to dispose the shade assembly 210 in an at least partially outward relation relative to the attachment device 220.

Figure 21:
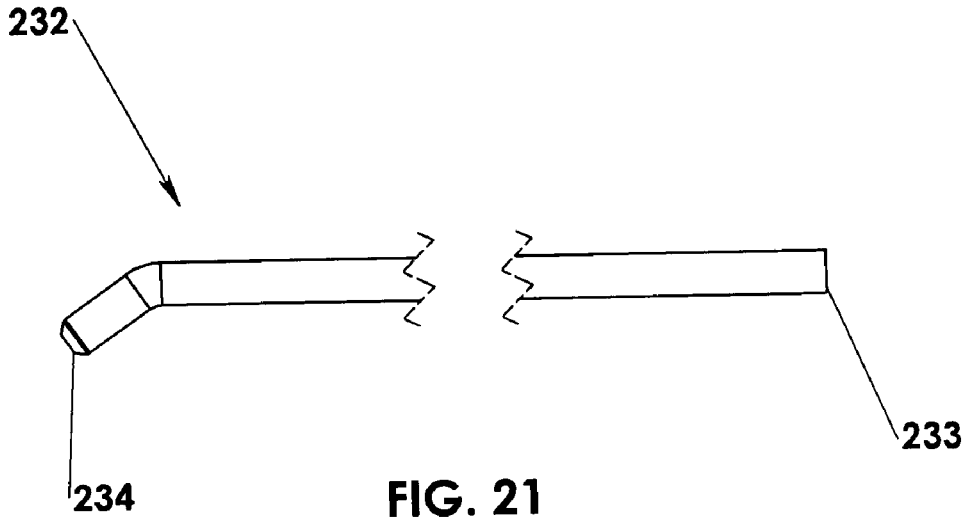
FIG. 21 is a schematic representation of one embodiment of the support pole of the shade assembly of the present invention.
Figure 21A:
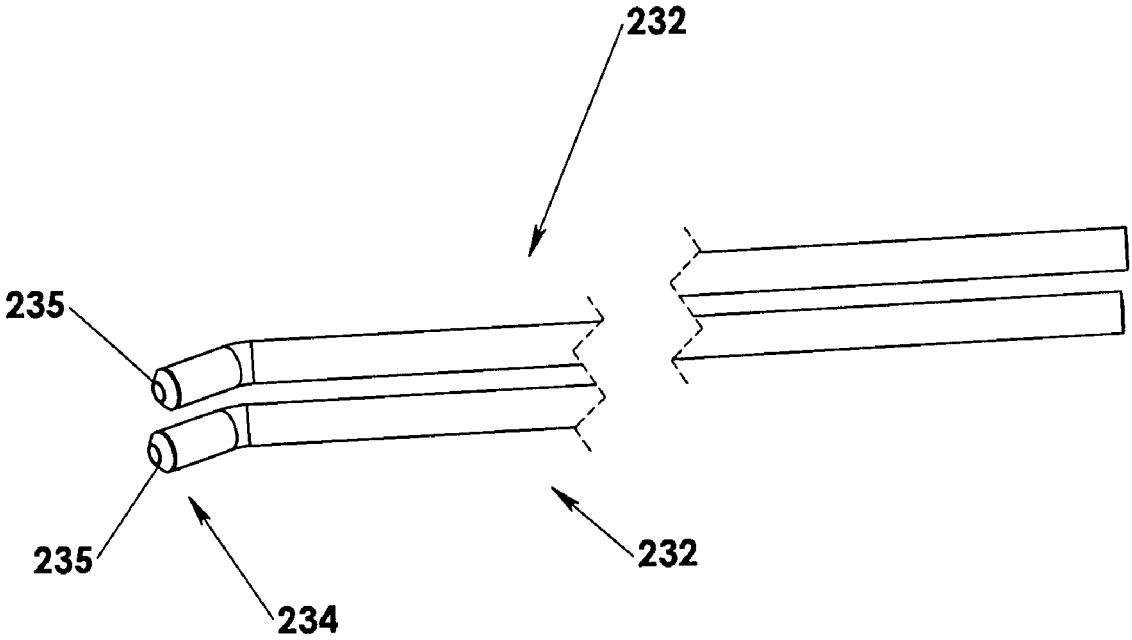
FIG. 21*a* is a perspective view of a plurality of support poles as represented in FIG. 21 including the distal ends of the support pole of FIG. 21.
Figure 22:
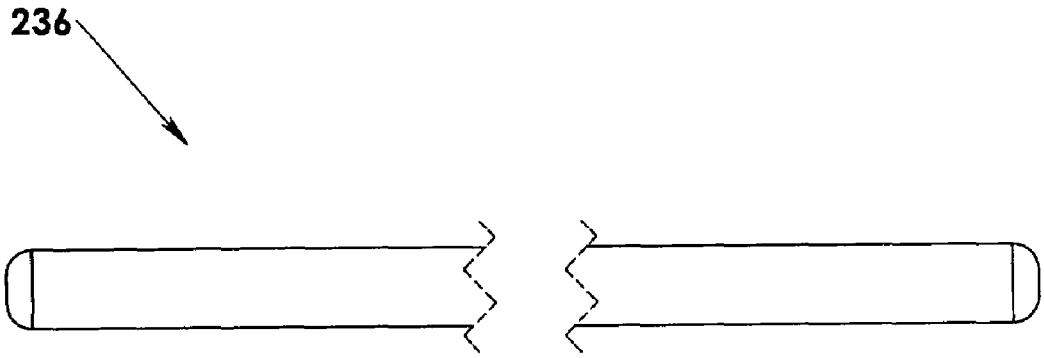
FIG. 22 is a schematic representation of one embodiment of the connecting support pole of the shade assembly of the present invention.
Figure 22A:
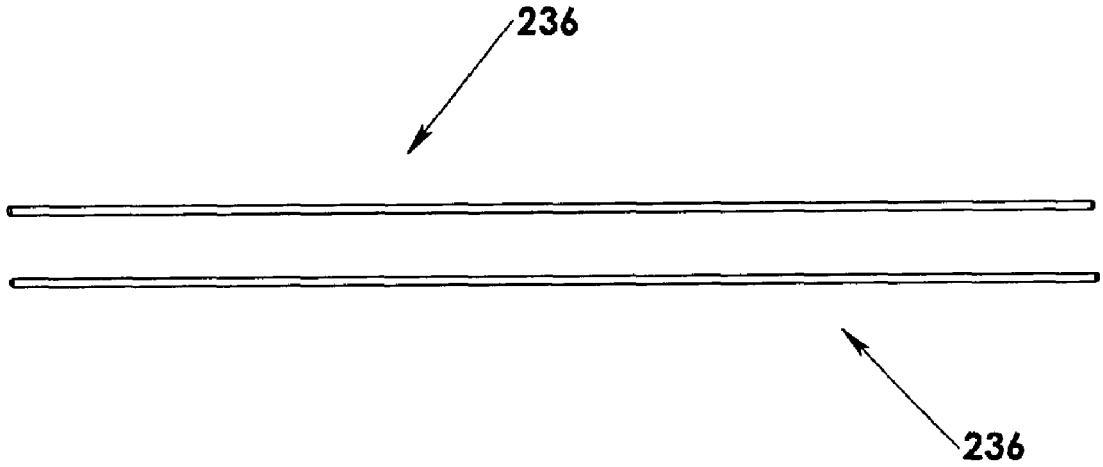
FIG. 22*a* is a side view of two connecting support poles of the shade assembly of the present invention.

Furthermore, in at least one embodiment of the present invention, as shown in FIGS. 21 and 21*a*, the distal end 234 of the support arms 232 may, but need not, comprise an at least partially angular configuration. Additionally, the tip of the distal end 234 of the support arms 223 may further be structured to include a cavity 235 configured to receive an end of at least one connecting support arm 236. The connecting support arm(s) 236, illustrated in FIGS. 22 and 22*a*, may preferably be structured in a substantially straight configuration. However, the one or more connecting support arm(s) 236 may comprise a curved, angled, or at least partially arcuate configuration.

Figure 23:
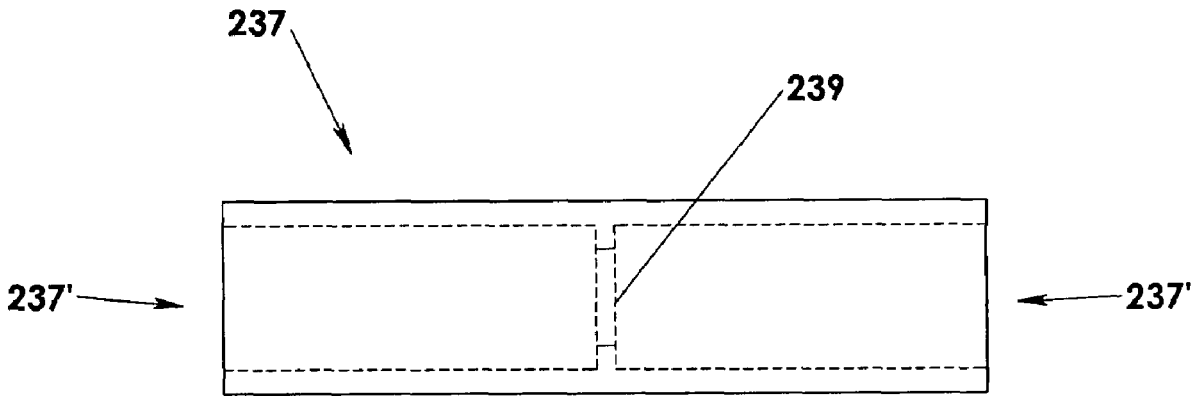
FIG. 23 is a schematic representation of the connector of one preferred embodiment of the shade assembly of the present invention.
Figure 23A:
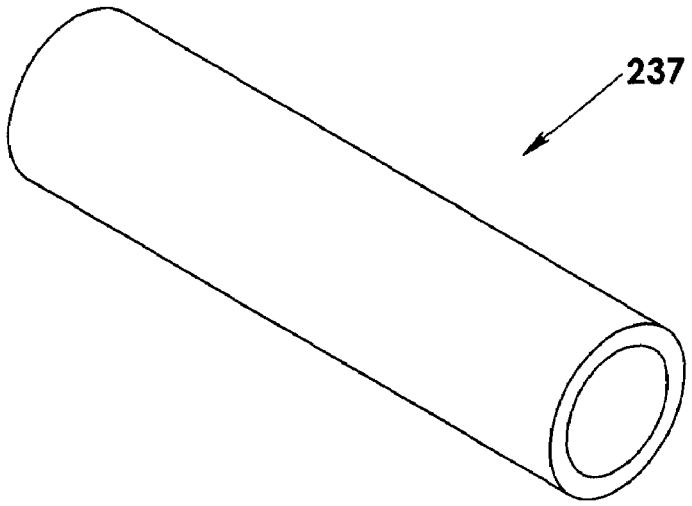
FIG. 23*a* is an exterior perspective view of the connector of embodiment of FIG. 23 associated with the shade assembly of the present invention.

In at least one embodiment of the present invention, the cover assembly 220 may further include a tube-like connector 237. The connector 237 is structured to connect or secure an end of one of said connecting support arms 236 to an end of a different one of said connecting support arms 236. The connector 237 may include one or more inner channels 237' and preferably a separator 239. The inner channels 237' are cooperatively structured to facilitate the insertion of an end of a connecting support arm 236 therein. Further, the separator 239 may include any structure, such as a wall, disposed at or near the center of the connector 237 preferably to allow each end of the connecting support arms 236 to be evenly disposed therein. As such, the separator 237 may be structured to prevent the end of the connecting support arm 236 from being inserted into the connector 237 beyond a certain point defined by the location of the separator 239. In addition, the connector 237 may be a separate, independent structure, as shown in FIGS. 23 and 23*a*, or the connector 237 may be at least partially structurally integrated or connected to one or more connecting support arms 236.

As will be explained below, it is generally preferable if the cover member 238 is installed or disposed onto at least one of the support arms 232 or connecting support arms 236 prior to securing the ends of the connecting support arms 236 with the connector 237. However, any order of assembly may be contemplated to facilitate the intended operation of the present invention.

Figure 24:
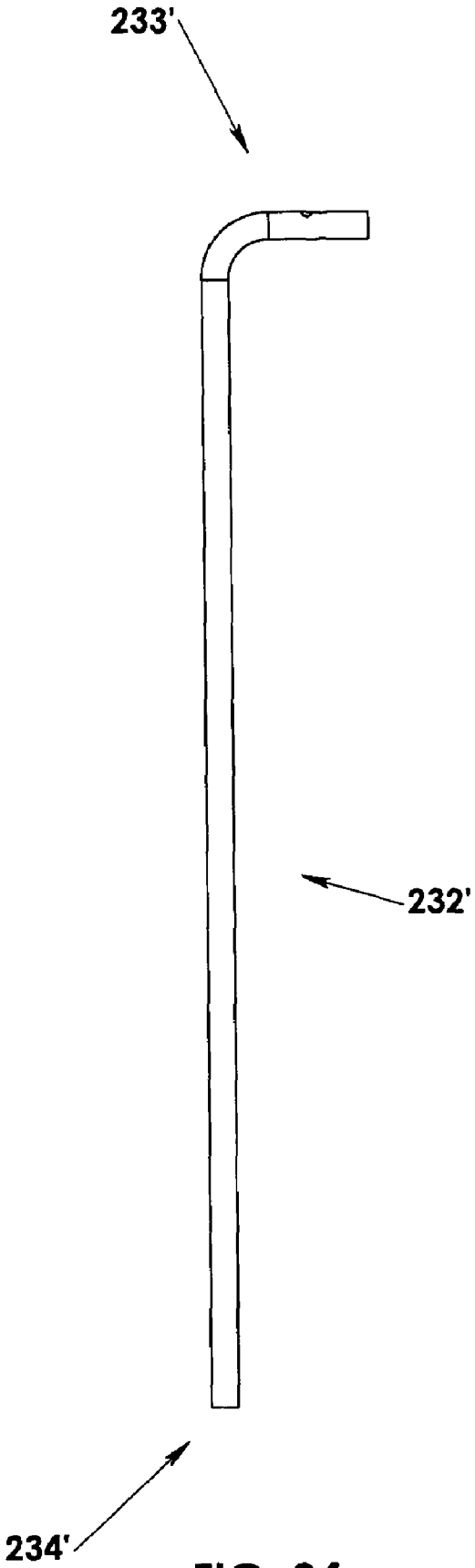
FIG. 24 is a schematic representation of a variation of the support pole of one embodiment of the shade assembly of the present invention.

As shown in FIG. 24, at least one embodiment of the present invention may include support arms 232' having a substantially angled orientation disposed at its proximal end 233'. Accordingly, the proximal end 233' of the support arm 232' may be operatively disposed within a receiving member 222 of the attachment device 220. Because of its substantially angled orientation, the distal end 234' of the support arm 232' is disposed at an at least partially perpendicular orientation relative to the face of the attachment device 220 having receiving members 222. As such, the support arms 232' will facilitate the use of a cover assembly 230 disposed in a perpendicular relation to the attachment device 220. Further, the support arm 232' may include a Velcro strip disposed along the length thereof. As will be described below, the Velcro strip may facilitate the attachment of the cover member 238 thereto.

Figure 25:
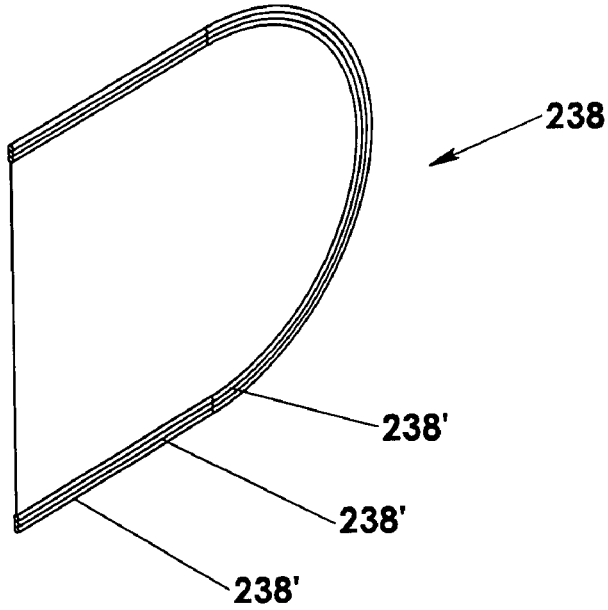
FIG. 25 is a perspective schematic representation of one preferred embodiment of the cover member of the shade assembly of the present invention.
Figure 25A:
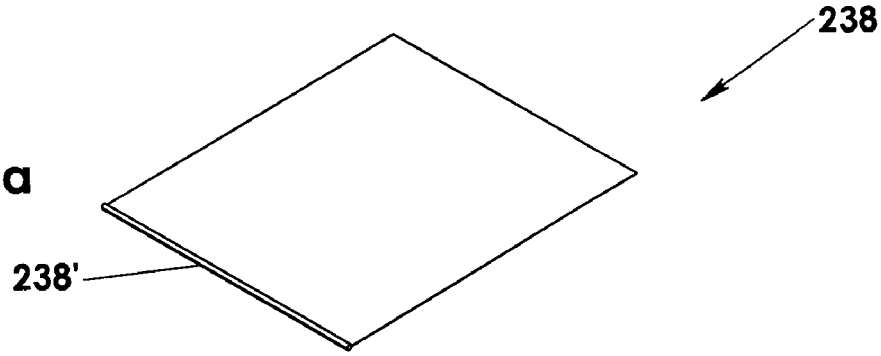
FIG. 25*a* is a perspective schematic representation of another cover member of one embodiment of the shade assembly of the present invention.
Figure 25B:
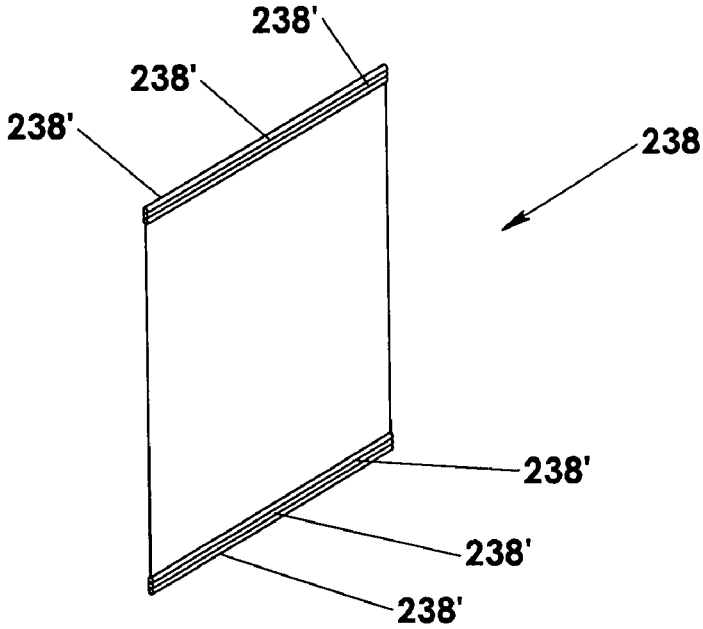
FIG. 25*b* is a perspective schematic representation of another variation of the cover member of one embodiment of the shade assembly of the present invention.

Referring now to FIGS. 25 through 25*b*, the cover member 238 of at least one embodiment of the present invention, may preferably comprise polyester, canvas, or other similar water or weather resistant materials. However, the cover member 238 may also be plastic, metal, or other harder, durable and/or less resilient materials. As shown in FIGS. 25 through 25*b*, the cover member 238 of the present invention may include one or more channels 238' extending substantially along one or more of the outer peripheral sides or edges thereof. Still referring to FIGS. 25 through 25*b*, the cover member 238 of the present invention may assume a plurality of shapes and configurations. For example, the cover member 238 of FIG. 25, includes an at least partially arcuate configuration and may preferable be disposed extending outwardly toward the front of the watercraft. In addition, the one or more channels 238' may be disposed along the sides of the cover member 238 as well as along the arcuate portions thereof.

Furthermore, the cover member 238 as shown in FIG. 25*a*, includes a substantially rectangular configuration and is intended to be disposed extending toward the sides of the watercraft. In the embodiment of FIG. 25*a*, the cover member 238 may include one or more channels 238' disposed on one or more of the sides thereof. Further, one or more sides of the cover member 238 may include any other securing mechanism or structure, including but not limited to Velcro, snaps, hooks and loops, or clamps. As such, in the embodiment wherein the support arm 232, 232', or 236 include a Velcro strip, or other similar device, disposed along the length thereof, the cover member 238 may be cooperatively structured to facilitate attachment thereto.

Referring now to FIG. 25*b*, the cover member 238 may include a rectangular configuration having one or more channels 238' on oppositely disposed sides thereof. Such an embodiment may preferably be disposed about the back of the watercraft, however any location may be implemented or contemplated.

The channels 238' may be structured and disposed to receive at least a portion of the support arm(s) 232, 232' and/or connecting support arm(s) 236 therein. As such, in the embodiments shown in FIGS. 25 through 25*b*, the cover member 238 may be slidingly disposed onto the support arms 232, 232' and/or the connecting support arms 236, much like a shower curtain may slide about a shower rod. The plurality of adjacently disposed channels 238' may provide versatility for use of the shade assembly 210 of the present invention with differently sized watercraft and differently spaced apart attachment devices 220. As such, the support arms 232 and the connecting support arms 236 may be disposed in any one of the plurality of channels 238' of the cover member 238 depending on the particular use and/or watercraft sizes and dimensions.

Furthermore, the various movable components or parts of the embodiments of the present invention represented in FIGS. 17 through 25 may be manually operated and/or electronically powered. For example, the supporting structure 231 may be movably disposable relative to the receiving member 222. Accordingly, the supporting structure 231 may be manually disposable or movable therein. However, similar to embodiments illustrated in FIGS. 26*b* and 27*b*, the present invention may include a motor or other various parts or components to facilitate, for example, the supporting structure 231 to be electronically powered.

Figure 26:
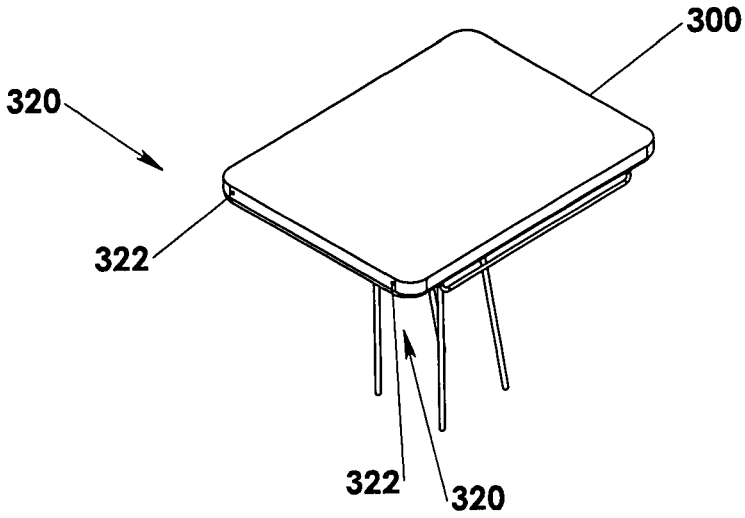
FIG. 26 is a perspective schematic representation of one embodiment of the present invention having an integrated attachment device.
Figure 26A:
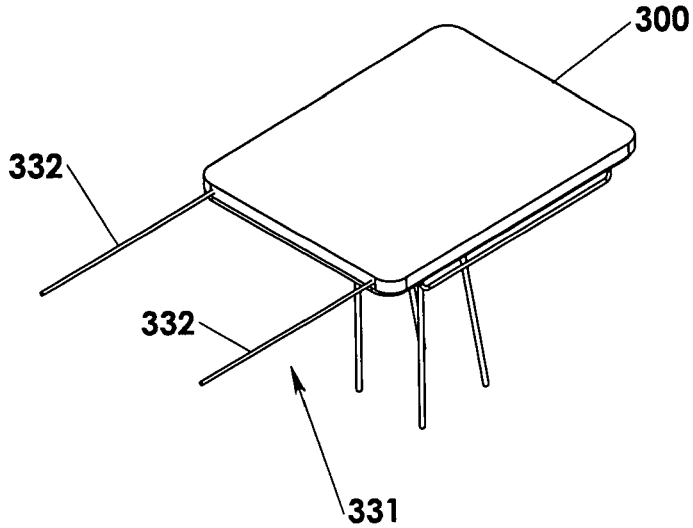
FIG. 26*a* is a perspective schematic representation of the embodiment illustrated in FIG. 26 having an at least partially extended supporting structure.
Figure 26B:
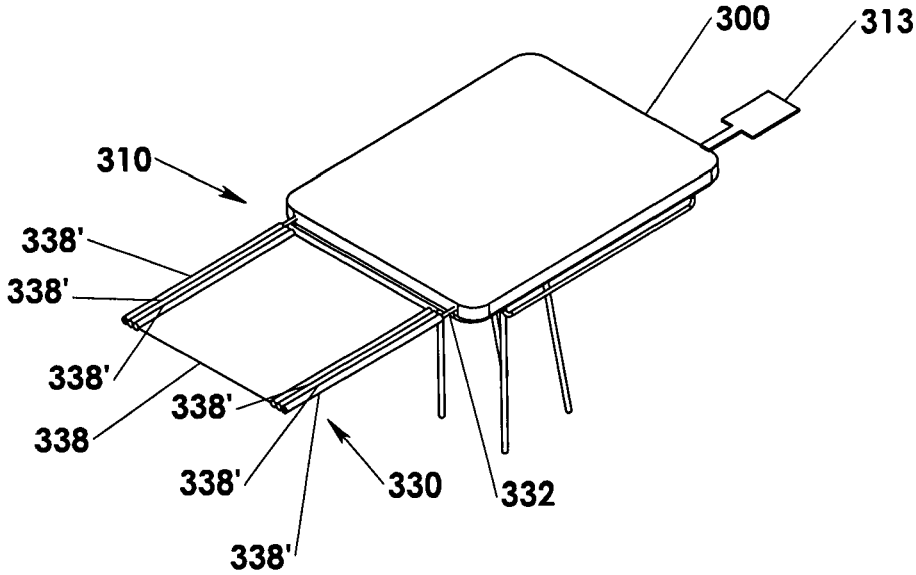
FIG. 26*b* is another perspective schematic representation of the embodiment illustrated in FIG. 26.
Figure 27:
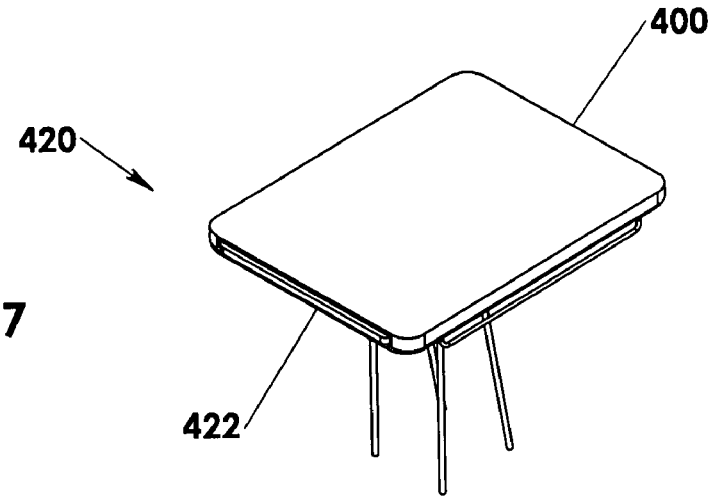
FIG. 27 is a perspective schematic representation another embodiment of the present invention.
Figure 27A:
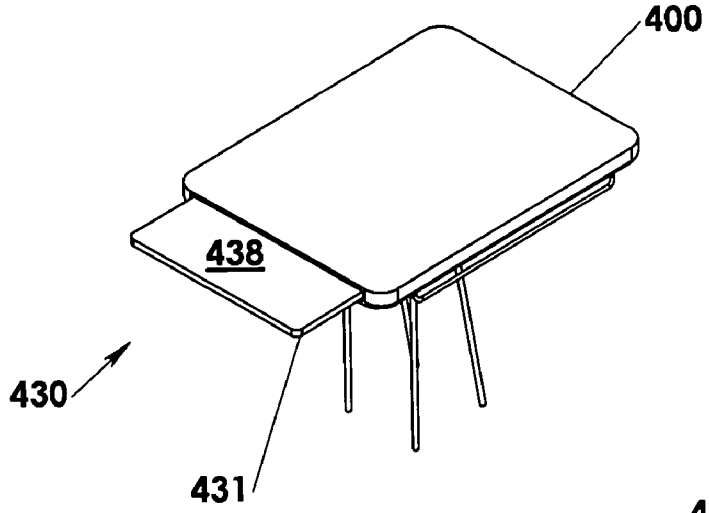
FIG. 27*a* is a perspective schematic representation of the embodiment illustrated in FIG. 27 having an at least partially extended cover assembly.
Figure 27B:
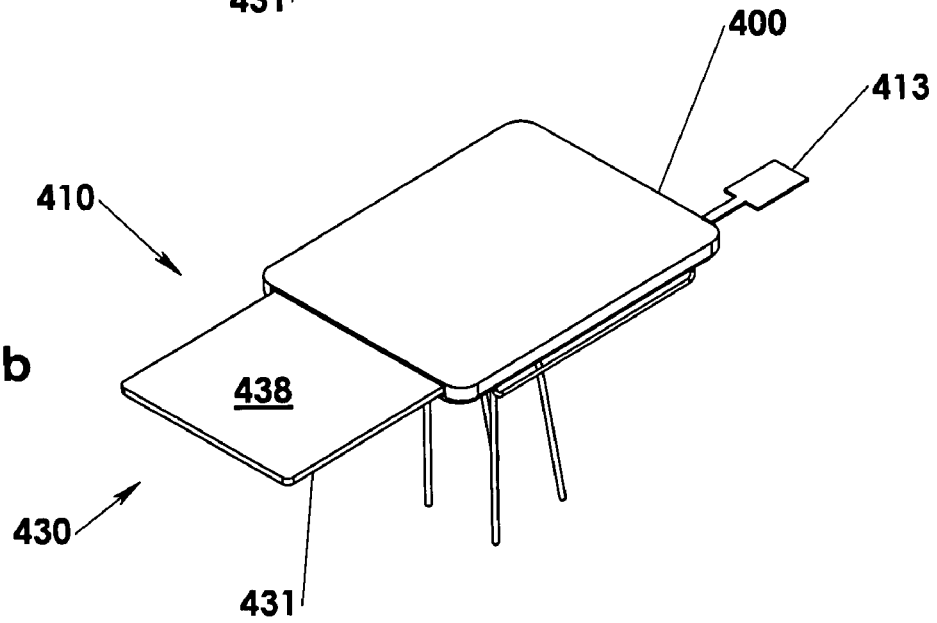
FIG. 27*b* is another perspective representation of the embodiment of the present invention illustrated in FIG. 27.

Referring now to FIGS. 26 through 27, and in particular FIGS. 26*b* and 27*b*, the shade assembly 310, 410 of the present invention may comprise an at least partially embedded or integrated embodiment. More in particular, the shade assembly 310 as illustrated in FIGS. 26, 26*a*, and 26*b*, includes an attachment device 320 structurally integrated, fixedly attached, or otherwise embedded with at least one predetermined portion of the watercraft, such as a "t-top", as at 300. The attachment device 320 may include one or more receiving members 322 preferably disposed at or near the edges of the predetermined portion of the watercraft. The receiving members 322 may be structured to define holes, bores, channels, or other similar members.

In addition, as shown in FIG. 26*a*, the shade assembly may include at least one supporting structure 331, which may be at least partially defined by one or more support arms 332. The support arms 332 may be cooperatively structured to be at least partially inserted into the receiving member(s) 322 of the attachment device 320. More in particular, the support poles 332 may be extended in an operative and outwardly orientation, as shown in FIG. 26*a*. However, the attachment device 320 and the support poles 322 may be cooperatively structured so as to dispose the support pole(s) 322 substantially therein, which may represent an at least partially stored orientation.

As shown in FIG. 26*b*, with the support poles 332 disposed in an operative and outwardly extending orientation, the cover member 338 may be disposed thereon, similar to at least one of the other embodiments of the present invention described above. Accordingly, the cover member 338 may include one or more channels 338' disposed on the outer peripheral edges thereof. The channels 338' are cooperatively structured and disposed to accept or receive at least a portion of the support pole(s) 332 thereon.

Furthermore, as shown in FIG. 26*b*, the shade assembly 310 of the present invention may include a motor 313 or other similar device structured to power a drive assembly. The drive assembly may include wheels, rollers, tubes, arms, or other movable parts structured to retractably dispose the shade assembly 310, and particularly, the supporting structure 331 into and out of the stored and operative positions. In addition, the drive assembly may instead, or additionally, be manually operated.

In addition, referring now to FIGS. 27, 27*a*, and 27*b*, at least one embodiment of the shade assembly 410 of the present invention may include an at least partially drawer like configuration. More in particular, as shown in FIG. 27, the shade assembly may include an attachment device 420 having at least one receiving member 422. The attachment device 420 of such an embodiment may include rollers, grooves, or any other similar drawer like devices structured to facilitate the practice of the invention in the intended fashion. Further, the receiving member 422 may be structured to define an elongated channel, bore, or other member to retractably store and/or dispose the cover assembly 320 into and out of one or more operative or stored positions. The cover assembly 430 may be completely removable from the predetermined portion 400 of the watercraft. However, the cover assembly 430 may be stored within the portions of the watercraft when not in use. It is also contemplated that the cover assembly 430 may be partially retracted, as shown in FIG. 27*a*, and secured into place, in addition to being completely retracted as shown in FIG. 27*b*.

Further, as illustrated in FIGS. 27*a* and 27*b*, the cover assembly 320 may include a supporting structure 431. The supporting structure 431 may include a frame or any other device or assembly structured to support the cover member 438.

Moreover, as illustrated in FIG. 27*b*, the shade assembly 410 of the present invention may include a motor 413 or other similar device structured to power a drive assembly. The drive assembly may include wheels, rollers, tubes, arms, or other similar movable parts structured to retractably dispose the shade assembly 410 into and out of a stored and operative position. Further, the shade assembly 410 may instead, or additionally, be manually operated.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A shade assembly for use on a watercraft comprising:

a cover assembly adjustably mounted on the watercraft in a protective position to any one of a plurality of predetermined portions of the watercraft, said cover assembly including at least one supporting structure and at least one cover member, said supporting structure including at least two support arms disposed in at least partially supporting relation to said cover member, said support arms having a proximal end and a distal end, wherein said distal end of each of said support arms includes an at least partially angular configuration, said supporting structure further comprising at least two connecting support arms disposed in at least partially supporting relation to said cover member, said connecting support arms being connectable to corresponding ends of said support arms, at least one attachment device operatively connecting said cover assembly to at least one predetermined and overhead portion of the watercraft, and said attachment device including at least one receiving member, at least a portion of said cover assembly disposed within said at least one receiving member.

2. A shade assembly as recited in claim 1 wherein each of said support arms includes a cavity disposed on a tip of said distal end thereof.

3. A shade assembly as recited in claim 2 wherein each of said connecting support arms is disposed into a corresponding one of said cavities disposed on said distal ends of said support arms.

4. A shade assembly as recited in claim 3 wherein an end of one of said connecting support arms is connected to an end of a different one of said connecting support arms.

5. A shade assembly as recited in claim 4 wherein said cover assembly further includes a connector disposed in interconnecting relation between an end of one said connecting support arms and an end of a different one of said connecting support arms.

6. A shade assembly as recited in claim 5 wherein said connecting support arms are collectively disposed to at least partially define an at least partially arcuate configuration of said cover assembly.

7. A shade assembly as recited in claim 1 wherein said cover member includes at least one channel extending substantially along an outer peripheral side thereof.

8. A shade assembly for use on a watercraft comprising:

a cover assembly adjustably mounted on the watercraft in a protective position to any one of a plurality of predetermined portions of the watercraft, said cover assembly including at least one supporting structure and at least one cover member, wherein said cover member includes at least one channel extending substantially along an outer peripheral side thereof, said supporting structure including at least two support arms disposed in at least partially supporting relation to said cover member, said support arms having a proximal end and a distal end, wherein at least portions of said two support arms are disposed within said channel, at least one attachment device operatively connecting said cover assembly to at least one predetermined and overhead portion of the watercraft, and said attachment device including at least one receiving member, at least a portion of said cover assembly disposed within said at least one receiving member.

9. A shade assembly as recited in claim 1 wherein said attachment device is structurally integrated with a predetermined portion of the watercraft.

10. A shade assembly as recited in claim 9 further comprising a motor retractably connected to said supporting structure, said supporting structure disposed between an at least partially stored position and an outwardly extending operative position.

11. A shade assembly as recited in claim 1 wherein said attachment device is removably connected to at least one predetermined portion of the watercraft.

12. A shade assembly as recited in claim 11 wherein said attachment device further includes a mounting assembly connected to at least one predetermined portion of the watercraft.

13. A shade assembly as recited in claim 12 wherein said mounting assembly is connected to any one of a plurality of different predetermined portions of the watercraft.

14. A shade assembly as recited in claim 13 wherein said mounting assembly is removably connected to any one of the plurality of predetermined portions of the watercraft.

15. A shade assembly as recited in claim 12 wherein said attachment device further includes at least one adjustment assembly disposed in interconnecting relation between said mounting assembly and said cover assembly; said cover assembly selectively disposed in any one of a plurality of operative positions relative to said mounting assembly and the watercraft.

16. A shade assembly as recited in claim 15 wherein at least a portion of said adjustment assembly is removably connected to said mounting assembly, said cover assembly disposed in different ones of said operative positions.

17. A shade assembly for use on a watercraft comprising:

a cover assembly adjustably mounted on the watercraft in a protective position to any one of a plurality of predetermined portions of the watercraft, said cover assembly including at least one supporting structure, at least one cover member, and at least two attachment devices, said supporting structure comprising a single support arm, said single support arm disposed in supporting relation to said cover member and connected to said two attachment devices, said attachment devices operatively connecting said cover assembly to at least one predetermined and overhead portion of the watercraft, and said attachment devices including at least one receiving member, at least a portion of said cover assembly disposed within said at least one receiving member.

18. A shade assembly as recited in claim 17 wherein said single support includes two opposite ends each connected to a different one of said two attachment devices.

19. A shade assembly as recited in claim 18 wherein said single support arm and a corresponding periphery of said cover member comprise a substantially arcuate configuration.

20. A shade assembly as recited in claim 1 wherein said at least one supporting structure is movably disposed relative to said receiving member.

21. A shade assembly as recited in claim 20 wherein said at least one supporting structure is manually operated.

22. A shade assembly as recited in claim 20 wherein said at least one supporting structure is electronically powered.

23. A shade assembly for use on a watercraft, comprising:

a cover assembly adjustably mounted on the watercraft in sun protecting position to various parts of the watercraft, said cover assembly including at least one supporting structure and at least one cover member, said supporting structure comprising at least one support arm disposable between an extended orientation and a stored orientation, at least one attachment device disposed in interconnecting relation between said cover assembly and at least one predetermined portion disposed above a hull of the watercraft, said attachment device including at least one receiving member; at least a portion of said cover assembly disposed within said at least one receiving member, at least a portion of said at least one support arm disposed in linearly sliding engagement through said receiving member and into and out of said extended orientation and said stored orientation, and said attachment device including at least one mounting assembly, said mounting assembly connected to at least one overhead portion of the watercraft.

24. A shade assembly as recited in claim 23 further comprising an adjustment assembly disposed in interconnecting relation between said mounting assembly and said cover assembly.

25. A shade assembly as recited in claim 24 wherein said cover assembly is connected to said adjustment assembly in at least one operative position relative to the predetermined portion of the watercraft to which it is connected.

26. A shade assembly as recited in claim 25 wherein said support arm is connected to said receiving member and movable with said cover member and at least partially with said adjustment assembly into any one of a plurality of operative positions.

27. A shade assembly as recited in claim 26 wherein said support arm is manually disposed into any one of said plurality of operative positions.

28. A shade assembly as recited in claim 26 wherein said support arm is electronically powered into any one of said plurality of operative positions.

29. A shade assembly for use on a watercraft, comprising:

at least one mounting assembly connected to any one of a plurality of predetermined and overhead portions of the watercraft, a cover assembly disposed on the watercraft in weather protecting relation to various portions of the watercraft, at least one adjustment assembly disposed in interconnecting relation between said mounting assembly and said cover assembly, said cover assembly connected to said adjustment assembly in at least one operative position relative to the predetermined portion of the watercraft to which it is connected, said cover assembly comprising at least one cover member and at least one support arm disposed in at least partially supporting relation to said cover member, said at least one support arm comprising a plurality of segments movable relative to one another and to said adjustment assembly, and said cover assembly movably connected to said adjustment assembly and selectively disposed into and out of said at least one operative position.

30. A shade assembly as recited in claim 29 wherein said cover assembly comprises two, spaced apart support arms each including a plurality of relatively movable segments selectively disposed, along with said cover member, into and out of said at least one operative position.

31. A shade assembly for use on a watercraft, comprising:

at least one mounting assembly connected to any one of a plurality of predetermined and overhead portions of the watercraft, a cover assembly disposed on the watercraft in weather protecting relation to various portions of the watercraft, at least one adjustment assembly disposed in interconnecting relation between said mounting assembly and said cover assembly, said cover assembly connected to said adjustment assembly in at least one operative position relative to the predetermined portion of the watercraft to which it is connected, a housing connected to said mounting assembly in retaining relation to said one cover member and said at least one support arm in a stored orientation, and said cover assembly movably connected to said adjustment assembly and disposed into and out of said at least one operative position.

32. A shade assembly as recited in claim 29 further comprising a drive assembly connected in driving, activating relation to said adjustment assembly, said adjustment assembly activated to position said cover assembly into and out of said operative positions.

33. A shade assembly as recited in claim 32 wherein said drive assembly is electronically powered.

34. A shade assembly as recited in claim 32 wherein said drive assembly is manually operated.

* * * * *